US008752742B2

(12) United States Patent
Clark et al.

(10) Patent No.: US 8,752,742 B2
(45) Date of Patent: Jun. 17, 2014

(54) HOLSTER ASSEMBLY AND METHOD USING SAME

(75) Inventors: William E. Clark, Vail, AZ (US); Victor Stevens, Sahuarita, AZ (US)

(73) Assignee: SlideTEK LLC, Poulsbo, WA (US)

( * ) Notice: Subject to any disclaimer, the term of this patent is extended or adjusted under 35 U.S.C. 154(b) by 2289 days.

(21) Appl. No.: 11/455,412

(22) Filed: Jun. 19, 2006

(65) Prior Publication Data

US 2010/0219216 A1 Sep. 2, 2010

Related U.S. Application Data

(63) Continuation-in-part of application No. 11/291,631, filed on Nov. 30, 2005.

(51) Int. Cl.
*F41C 33/02* (2006.01)

(52) U.S. Cl.
USPC ..... 224/243

(58) Field of Classification Search
USPC ..... 224/243, 244, 911, 912, 192, 193, 249, 224/198, 196, 245, 663, 238; 42/70.07, 42/70.06, 70.11, 87, 88; 206/317; 211/64
See application file for complete search history.

(56) References Cited

U.S. PATENT DOCUMENTS

| | | | | |
|---|---|---|---|---|
| 1,046,912 A | | 12/1912 | Wanee | |
| 1,557,339 A | * | 10/1925 | Sander | 224/542 |
| 2,132,323 A | * | 10/1938 | Sander | 224/281 |
| 3,105,611 A | * | 10/1963 | Conti | 221/248 |
| 3,763,587 A | | 10/1973 | Firmalino | |
| 3,804,306 A | | 4/1974 | Azurin | |
| 4,138,044 A | | 2/1979 | Musgrave | |
| 4,298,150 A | | 11/1981 | Seldeen | |
| 6,948,644 B1 | * | 9/2005 | Beletsky | 224/193 |

* cited by examiner

*Primary Examiner* — Nathan J Newhouse
(74) *Attorney, Agent, or Firm* — Dale F. Regelman; Quarles & Brady LLP

(57) ABSTRACT

A holster assembly, and method using same, are disclosed. The holster comprises a base, a barrel housing assembly fixedly attached to that base, a moveable trigger guard assembly slidably attached to the barrel housing assembly, and one or more springs disposed between the barrel housing assembly and the moveable trigger guard assembly, wherein the moveable trigger guard assembly can be slidingly moved bidirectionally between a first position and a second position.

6 Claims, 28 Drawing Sheets

HOLSTER ASSEMBLY AND METHOD USING SAME

CROSS-REFERENCE TO RELATED APPLICATIONS

This Application is a Continuation-In-Part claiming priority from the U.S. Utility application having Ser. No. 11/291,631 filed Nov. 30, 2005.

FIELD OF THE INVENTION

The invention relates to a holster for a handgun, and a method using same.

BACKGROUND OF THE INVENTION

Various holster designs are known in the art. Many police, military, and security personnel, carry firearms for the protection of the public and themselves. Such firearms often comprises handguns referred to as "self-loading" pistols. For safety reasons, those self-loading pistols are carried in a holster, and do not have a round loaded in the firing chamber.

In an emergent situation, such police, military, security personnel may have occasion to draw the pistol from the holster and discharge that weapon. The time required to remove the pistol from the holster and then to manually move a sliding portion of the pistol to dispose a round in the firing chamber is critical.

What is needed is a holster assembly that facilitates loading a round into the firing chamber, and assists the removal of the loaded pistol from the holster. Applicant's holster assembly, and method using same, achieves these objectives.

SUMMARY OF THE INVENTION

Applicant's invention includes a holster, comprising a base; a barrel housing assembly fixedly attached to said base; and a moveable trigger guard assembly slidably attached to the barrel housing assembly, and one or more springs disposed between the barrel housing assembly and the moveable trigger guard assembly, wherein the moveable trigger guard assembly can be slidingly moved bidirectionally between a first position and a second position.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 7A:
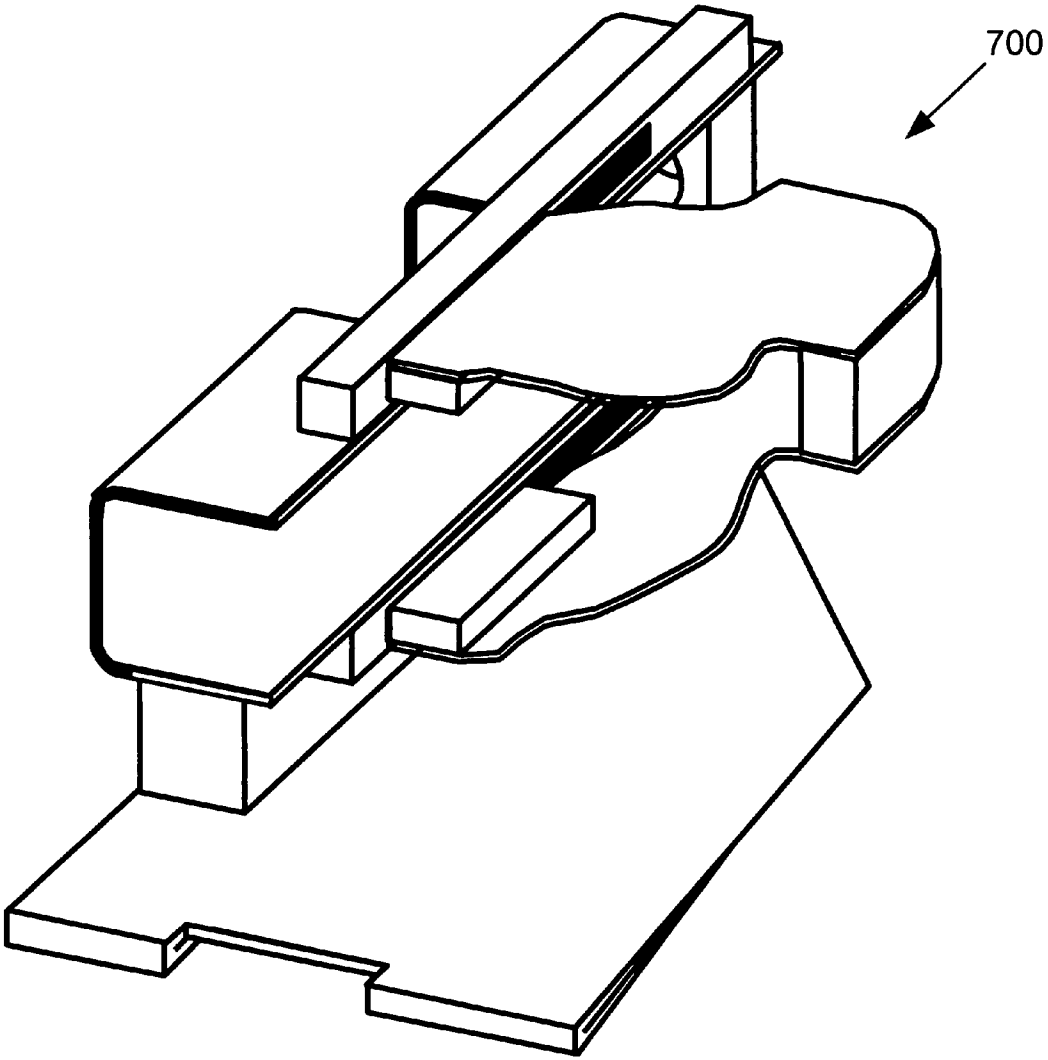
FIG. 7A is a perspective view of Applicant's holster showing the moveable trigger guard in a first position.
Figure 8A:
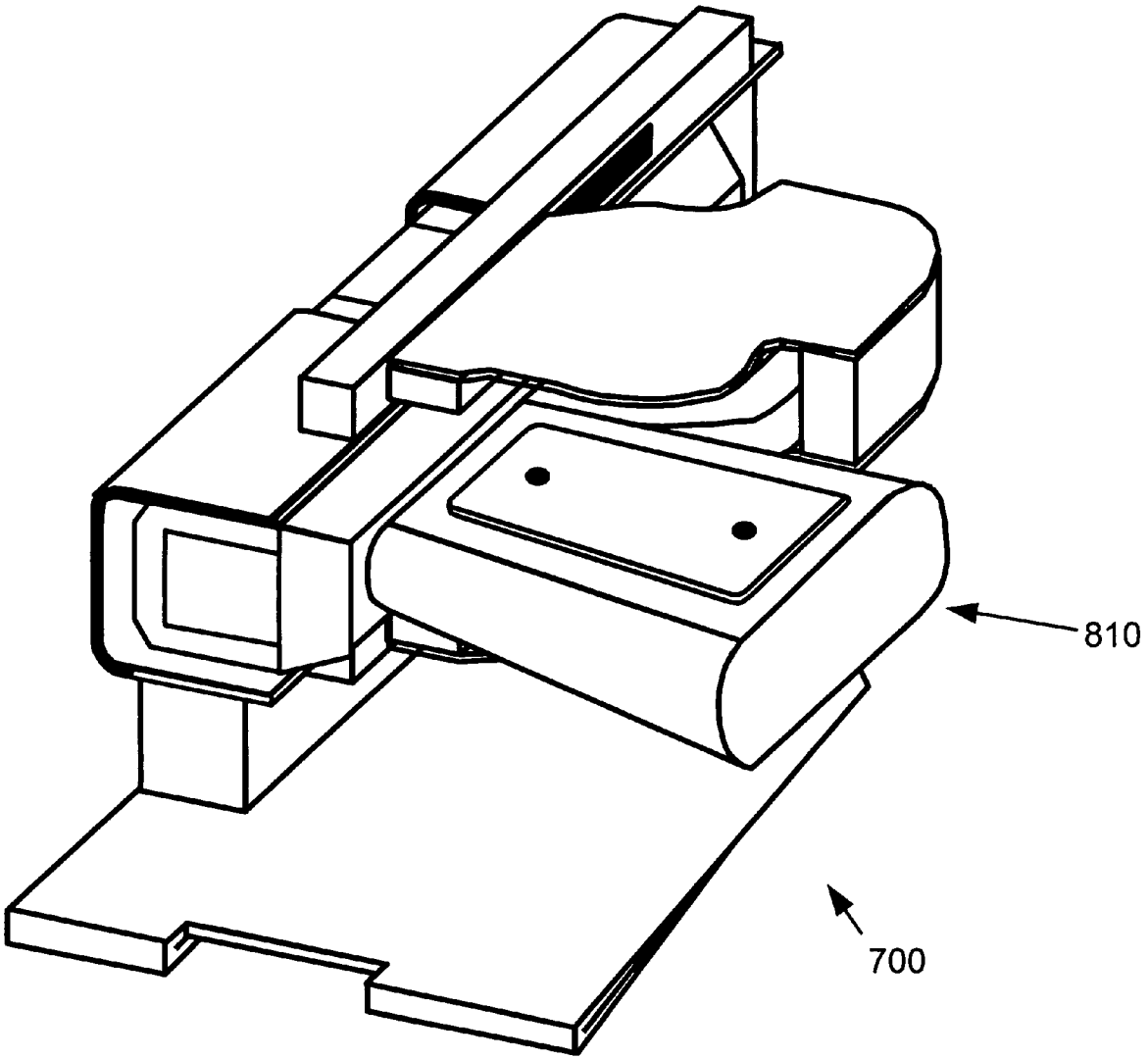
FIG. 8A is a perspective view showing a pistol removeably disposed within Applicants' holster assembly, wherein Applicants' moveable trigger guard is shown in the first position of FIG. 7A.

FIG. 7A shows a perspective view of Applicant's holster assembly 700. FIG. 8A shows a perspective view of Applicant's holster assembly 700 with pistol 810 removeably disposed therein.

As described in more detail herein below, Applicant's holster assembly 700 facilitates loading a round into the firing chamber of pistol 810, and assists the removal of the loaded pistol from the holster. In addition, Applicant's holster assembly and method allow the user to load pistol 810 using only one hand. Using prior art holsters, two hands are needed to withdraw and load a pistol from a holster.

Such one-handed operation allows disabled persons, or persons having limited use of one arm, to operate an automatic pistol for self protection, hunting, competition, or target shooting in general. In addition such one-handed operation is a significant benefit for police, military, and/or security personnel. For example, if a police officer is detaining a suspect with one hand and another person charges towards that officer, using a prior art holster the officer would have to release the suspect in order to use both hands to draw and cycle the pistol. Using Applicant's holster assembly and method, however, the officer can continue to detain the suspect with one hand, dispose a round into the firing chamber of the pistol in the holster with the other hand, and draw the pistol on the charging person without releasing the suspect.

Referring now to FIGS. 1A, 1B, 1C, and 1D, Applicant's holster assembly 700 comprises base 110. Base 110 comprises a planar member having a first end 111, a second end 113, a first width 116A at end 111, and a second width 116B at end 113. Ends 111 and 113 are interconnected by a first side 115 having length 114, and a second side 117, wherein side 117 is parallel to side 115 for a distance 118 measured from first end 111, and wherein side 117 then tapers inwardly toward side 115 thereafter. Base 110 further comprises a thickness 119, optional first clip 121, and optional second clip 123. In certain embodiments, base 110 is formed from a rigid material, such as without limitation wood, metal, molded plastic, leather, combinations thereof, and the like.

In certain embodiments, length 114 is between about 4 inches and about 12 inches. In certain embodiments, length 114 is about 9 inches. In certain embodiments, width 116A is between about 2 inches and about 6 inches. In certain embodiments, width 116A is about 4 inches. In certain embodiments, width 116B is between about 0.50 inches and about 3 inches. In certain embodiments, width 116B is about 1 inch.

In certain embodiments, thickness 119 is between about 0.20 inches and about 0.50 inches. In certain embodiments, thickness 119 is about 0.30 inches. In certain embodiments, width 116A tapers after length 118 to width 116B at end 113.

Figure 1A:
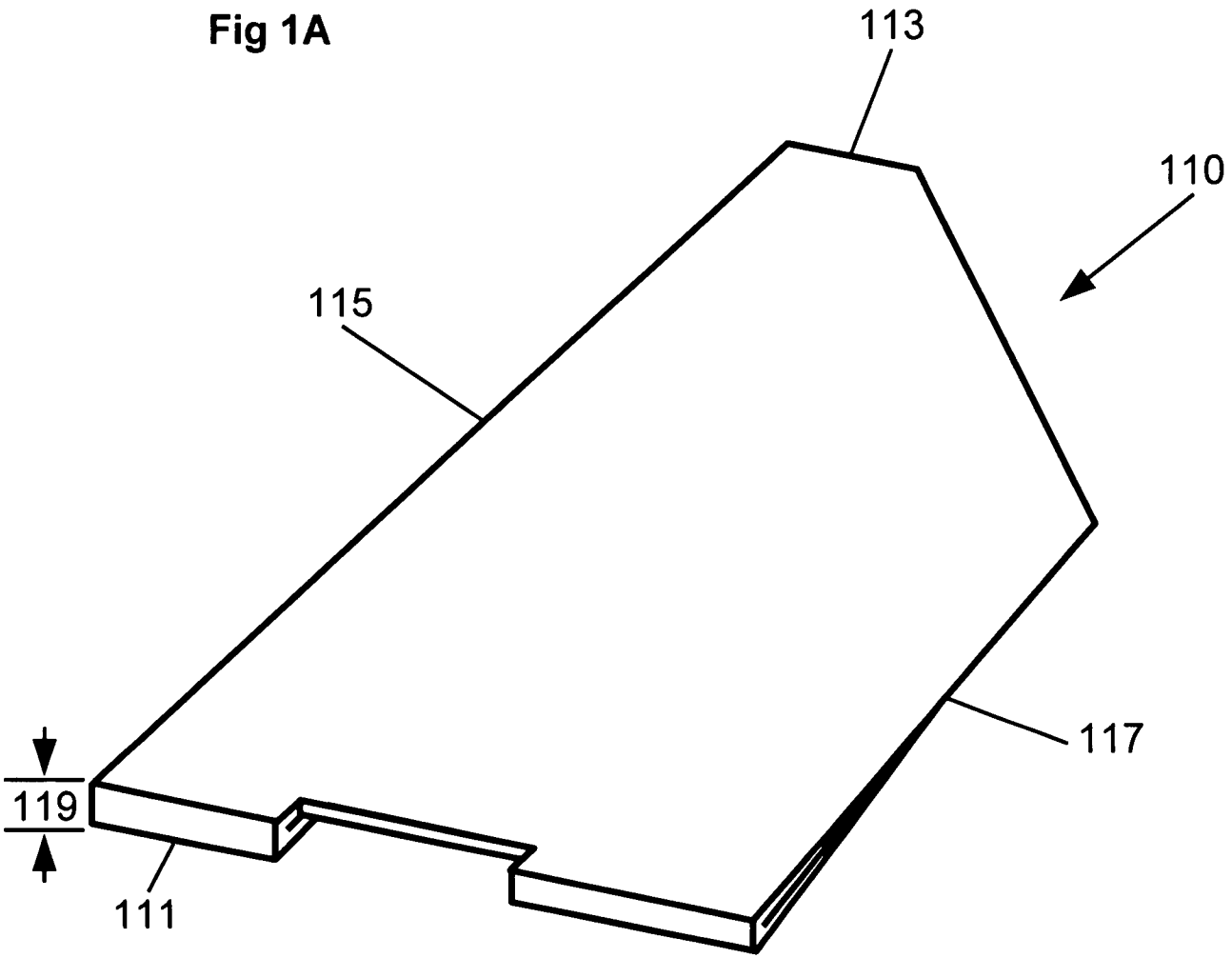
FIG. 1A is a perspective view of the base portion of Applicant's holster assembly.
Figure 1D:
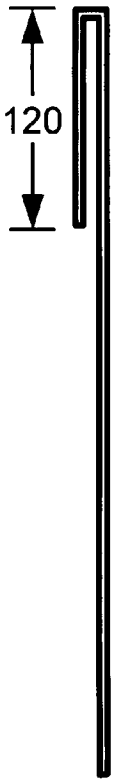
FIG. 1D is a side view of the base portion of FIG. 1A.
Figure 1C:
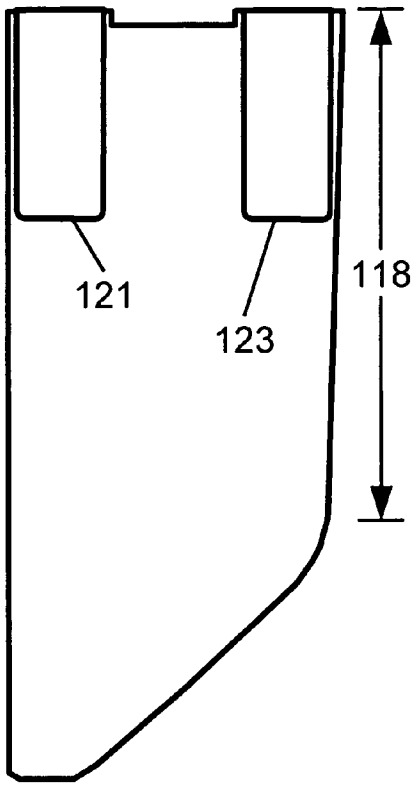
FIG. 1C is a bottom view of the base portion of FIG. 1A.
Figure 1B:
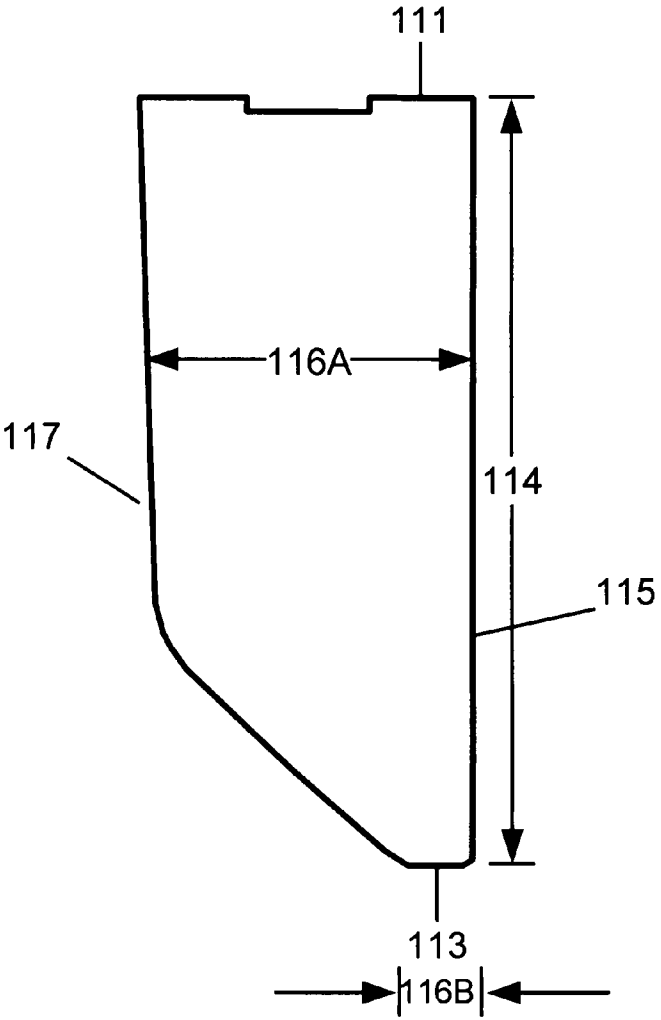
FIG. 1B is a top view of the base portion of FIG. 1A.

In the illustrated embodiments of FIGS. 1C and 1D, Applicants' holster assembly 700 comprises optional clips 121 and 123. As those skilled in the art will appreciate, first clip 121 and second clip 123 can be used to attach Applicants' holster assembly 700 to a belt, pant, or other clothing portion. In certain embodiments, clips 121 and 123 are integrally molded with base 110. In other embodiments, clip 121 and/or clip 123 are separately formed, and subsequently attached to base 110 using conventional attachment means, such as and without limitation, adhesive bonding, welding, and the like. First clip 121 and second clip 123 comprise a length 120. In certain embodiments, length 120 is between about 2 inches and 3 inches.

Figure 2A:
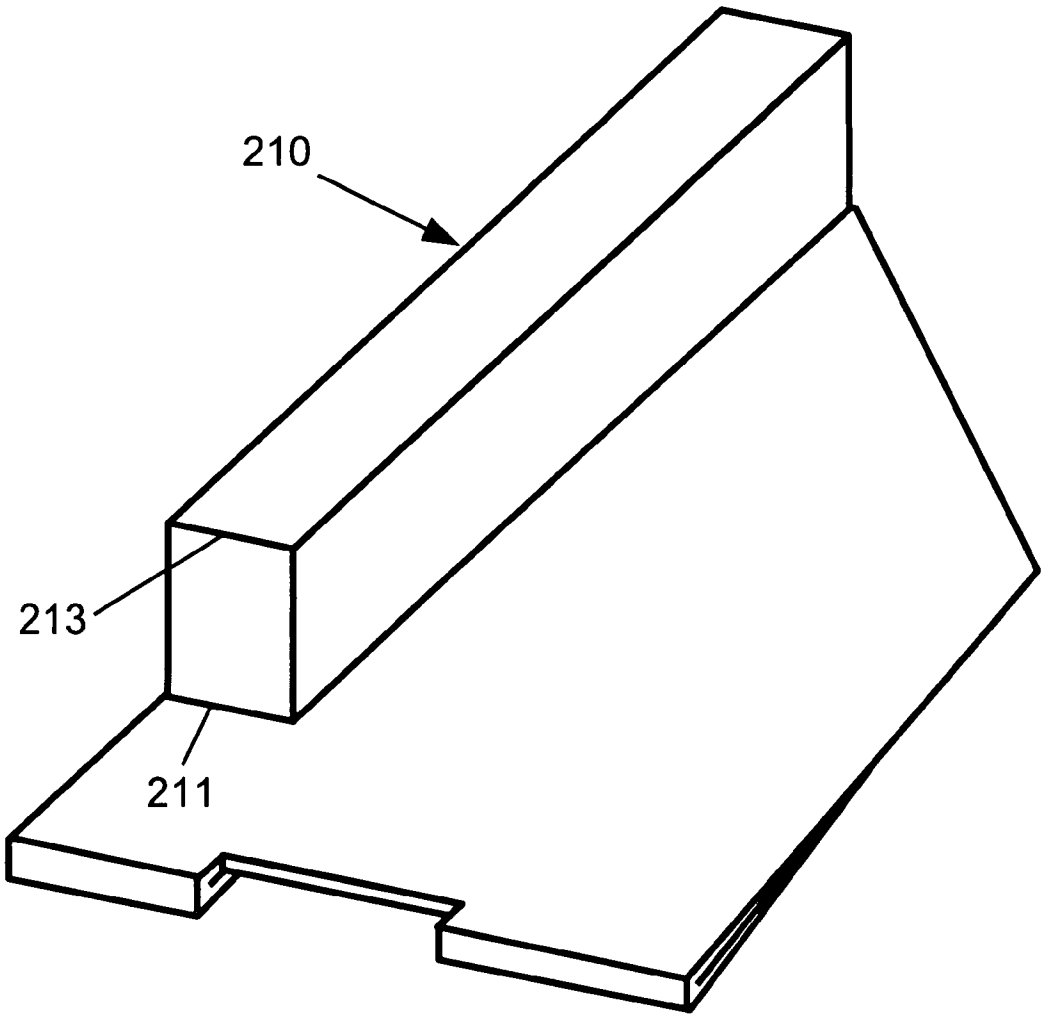
FIG. 2A is a perspective view showing the base of FIG. 1A in combination with a riser.
Figure 2B:
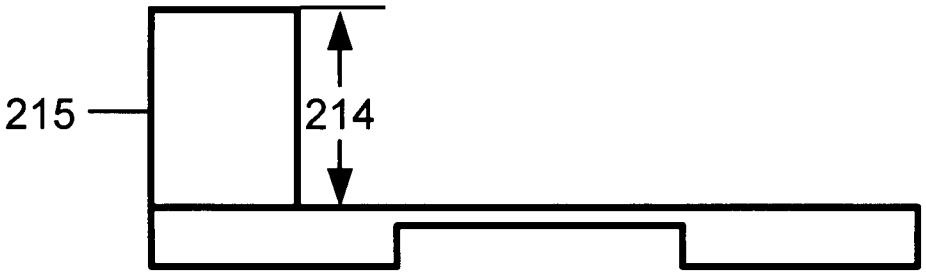
FIG. 2B is a side view showing the elements of FIG. 2A.
Figure 2C:
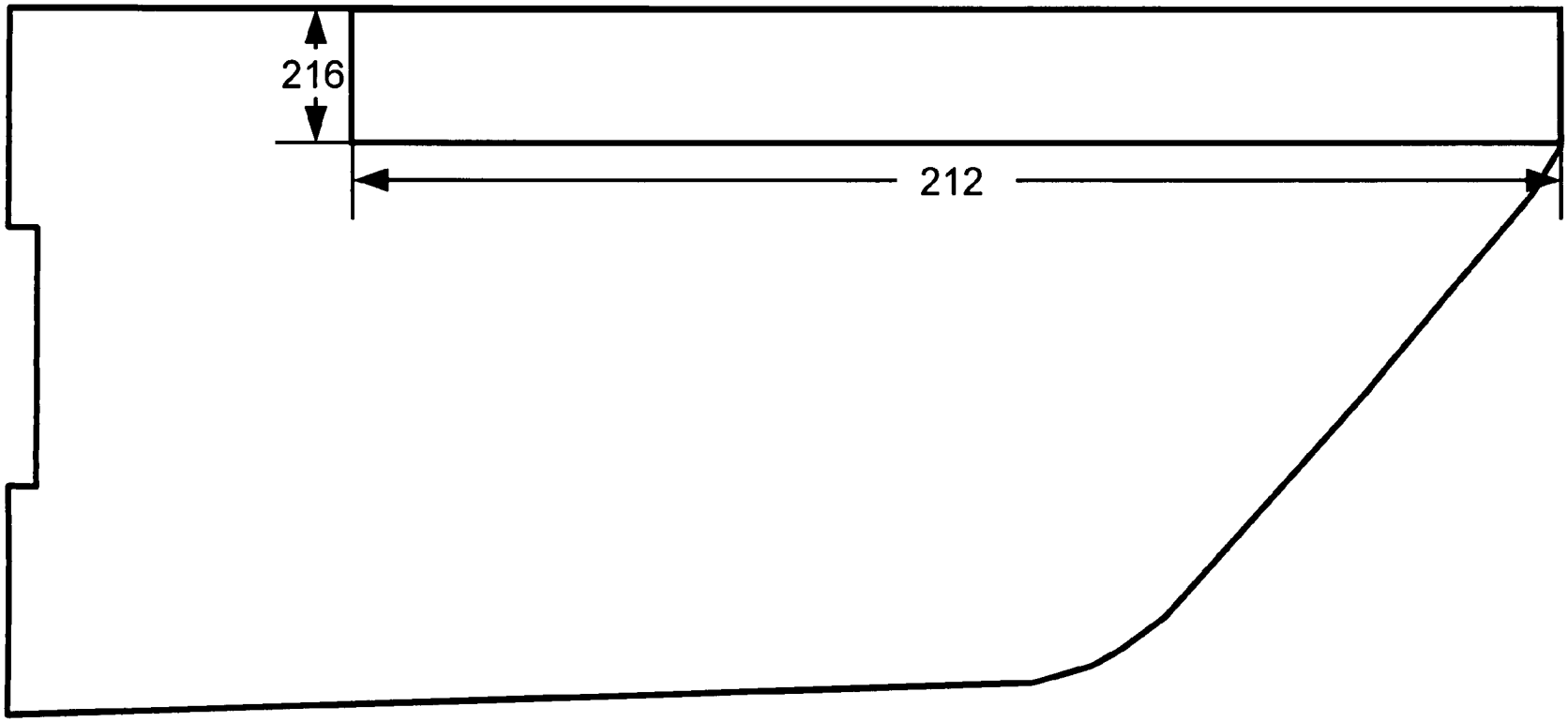
FIG. 2C is a top view showing the elements of FIG. 2A.

Referring to FIGS. 2A, 2B, and 2C, riser 210 comprises a first side 211 attached to base 110 and an opposing second side 213. Riser 210 further comprises length 212, height 214, and width 216. In certain embodiments, length 212 is between about 4 inches and about 12 inches. In certain embodiments, length 212 is about 7 inches. In certain embodiments, height 214 is between about 0.75 inches and about 1.50 inches. In certain embodiments, height 214 is about 1 inch. In certain embodiments, width 216 is between about 0.50 inches and about 1 inch. In certain embodiments, width 216 is about 0.75 inches.

Figure 3A:
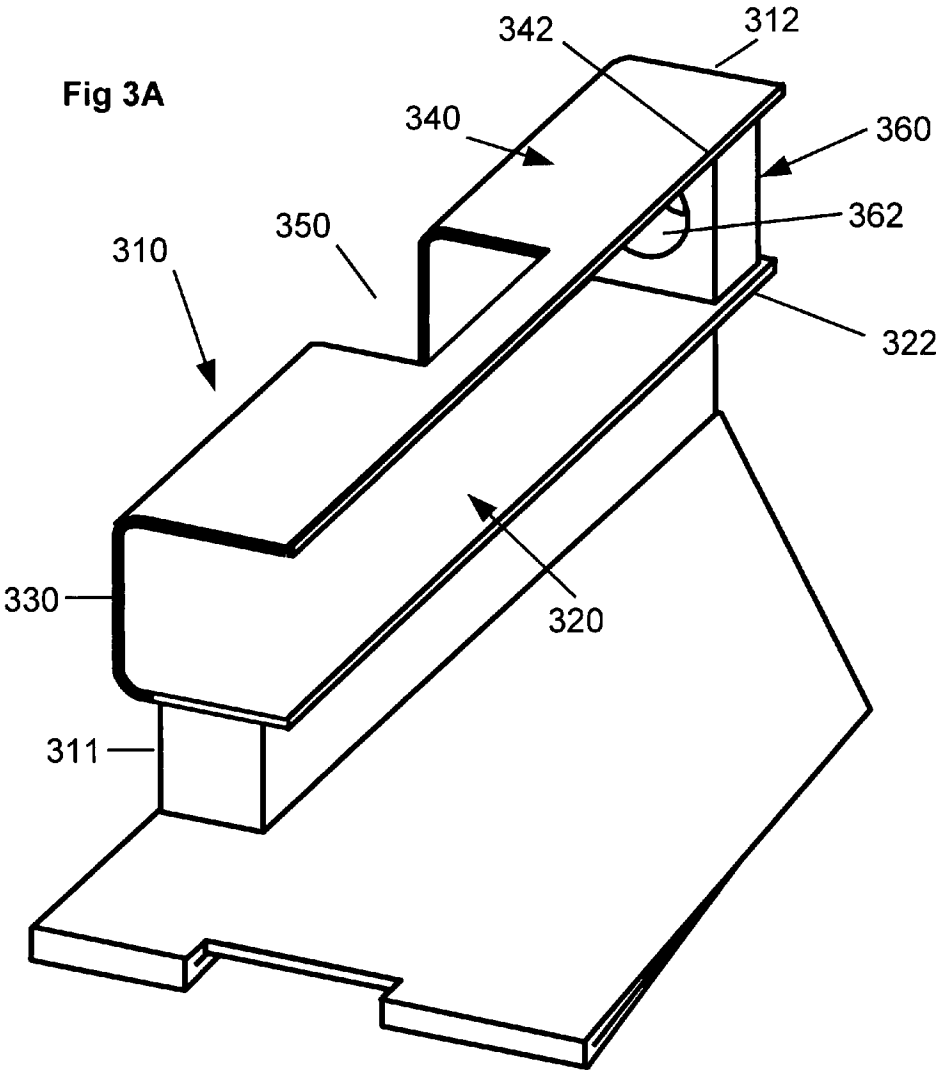
FIG. 3A is a perspective view showing the elements of FIG. 2A in combination with Applicants' barrel housing.
Figure 3B:
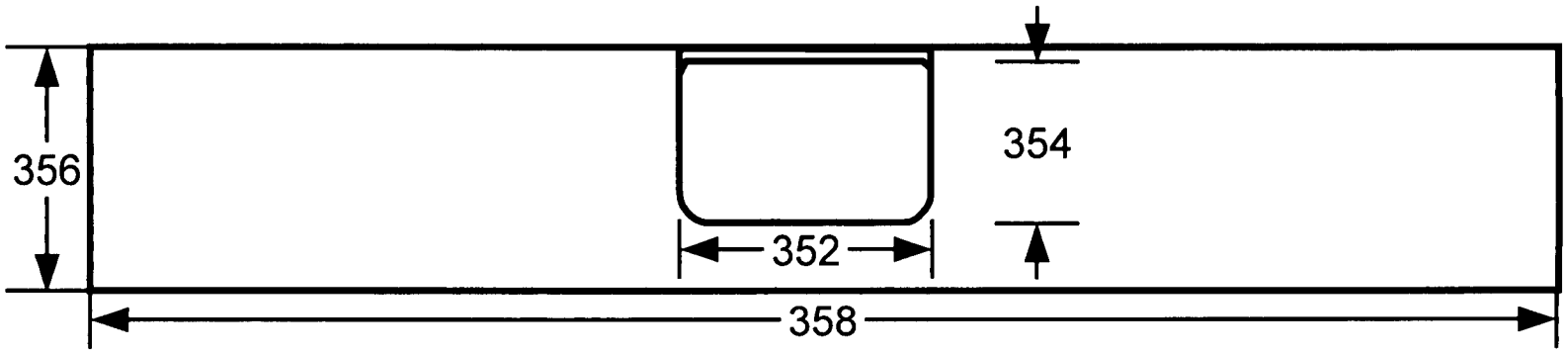
FIG. 3B is a top view showing the elements of FIG. 3A.
Figure 3C:
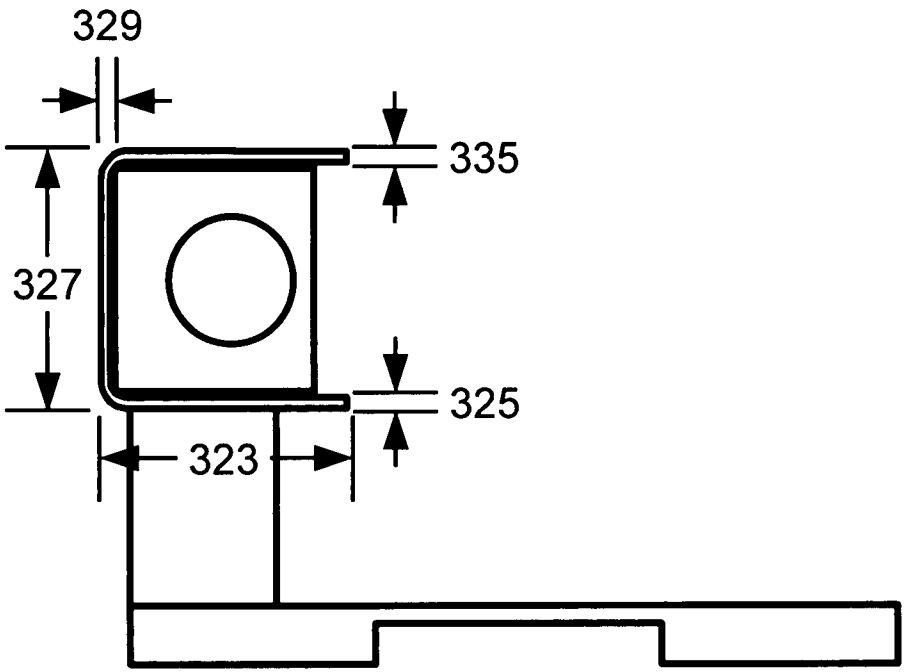
FIG. 3C is a side view showing one of the elements of FIG. 3A.

Referring now to FIGS. 3A, 3B, and 3C, barrel housing 310 comprises base planar member 320, side planar member 330, and top planar member 340. Housing 310 is mounted on side 213 of riser 210 such that member 330 is flush with side 215 of riser 210. In certain embodiments, top planar member 340 is formed to include aperture 350. In certain embodiments, housing 310 comprises an integrally molded assembly. In other embodiments, base planar member 320, side planar member 330, and top planar member 340, comprise separate elements which are attached to one another using conventional attachment means. In certain embodiments, base 110, riser 210, and housing 310 comprise an integrally molded assembly.

Base planar member 320 has a length 358, width 323, and thickness 325. In certain embodiments, length 358 is between about 4 inches and about 12 inches. In certain embodiments, length 358 is about 9 inches. In certain embodiments, width 323 is between about 0.5 inches and about 2 inches. In certain embodiments, width 323 is about 1.30 inches. In certain embodiments, thickness 325 is between about 0.05 inches and about 0.15 inches. In certain embodiments, thickness 325 is about 0.09 inches Side planar member 330 is attached to base member 320, and extends upwardly therefrom. Side planar member 330 has a length 358, a height 327, and a thickness 329. In certain embodiments, height 327 is between about 0.50 inches and about 2 inches. In certain embodiments, height 327 is about 1.30 inches. In certain embodiments, height 327 is between about 0.5 inches and about 2 inches. In certain embodiments, height 327 is about 1.33 inches. In certain embodiments, thickness 329 is between about 0.05 inches and about 0.15 inches. In certain embodiments, thickness 329 is about 0.09 inches.

Aperture 350 has a length 352 and width 354. In certain embodiments, length 352 is between about 0.50 inch and about 2 inches. In certain embodiments, length 352 is about 1.33 inches. In certain embodiments, width 354 is between about 0.50 inches and about 2 inches. In certain embodiments, width 354 is about 1 inch.

Top planar member 340 is attached to side planar member 330 and extends inwardly therefrom. Top planar member 340 has a length 358, a width 356, and a thickness 335. In certain embodiments, width 356 is between about 0.5 inches and about 2 inches. In certain embodiments, width 356 is about 1.30 inches. In certain embodiments, thickness 335 is between about 0.05 inches and about 0.15 inches. In certain embodiments, thickness 335 is about 0.09 inches.

In the illustrated embodiment of FIG. 3A, barrel port block 360 comprises a rectangular parallelepiped formed to include aperture 362 extending therethrough, wherein aperture 362 comprises a cylindrical shape. In other embodiments, aperture 362 comprises a shape selected from the group consisting of an inverted "U" shape, an "H" shape, and the like. Barrel port block 360 is disposed in distal end 312 of housing 310. In certain embodiments, aperture 362 has a diameter between about 0.5 inches and about 1 inches. In certain embodiments, aperture 362 has a diameter of about 0.7 inches.

Figure 4A:
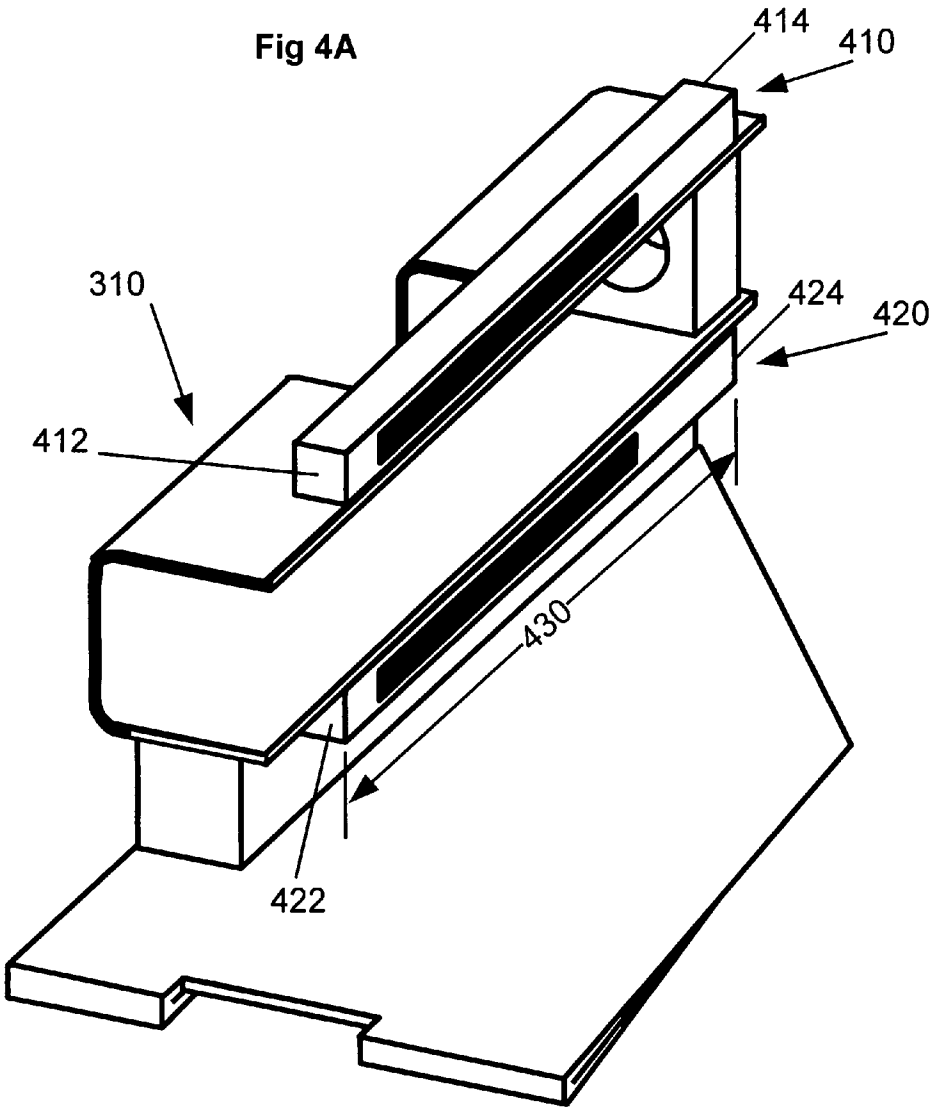
FIG. 4A is a perspective view showing the elements of FIG. 3A in combination with two slide rail elements.
Figure 4B:
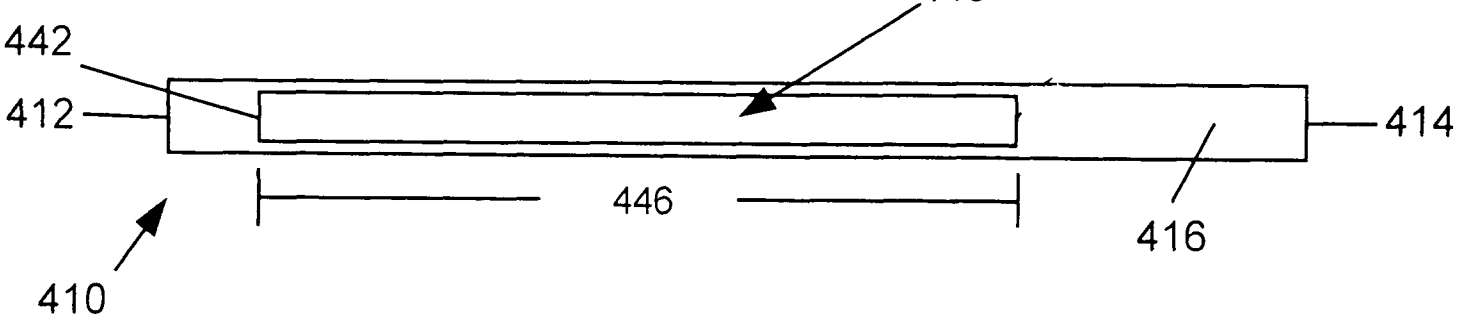
FIG. 4B is a side view a first slide rail.
Figure 4C:
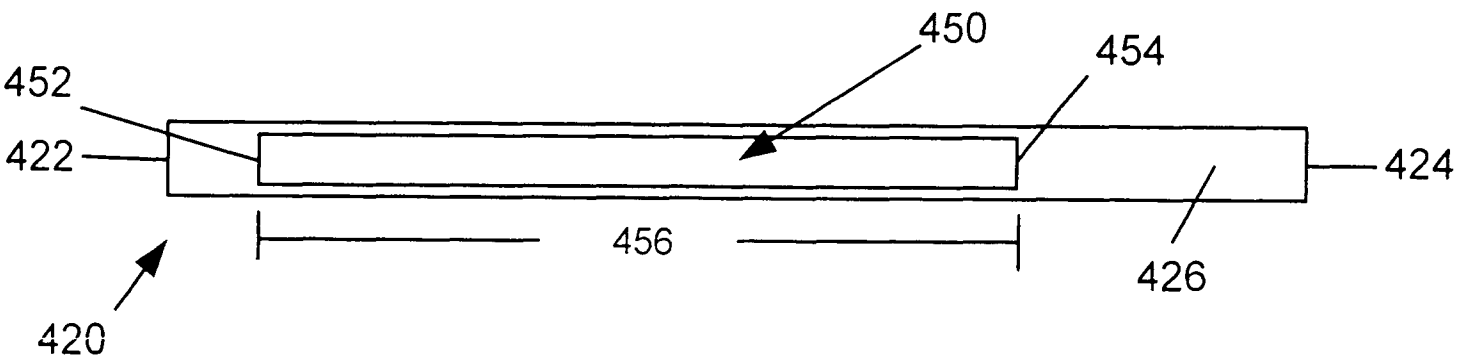
FIG. 4C is a side view of a second slide rail.
Figure 4D:
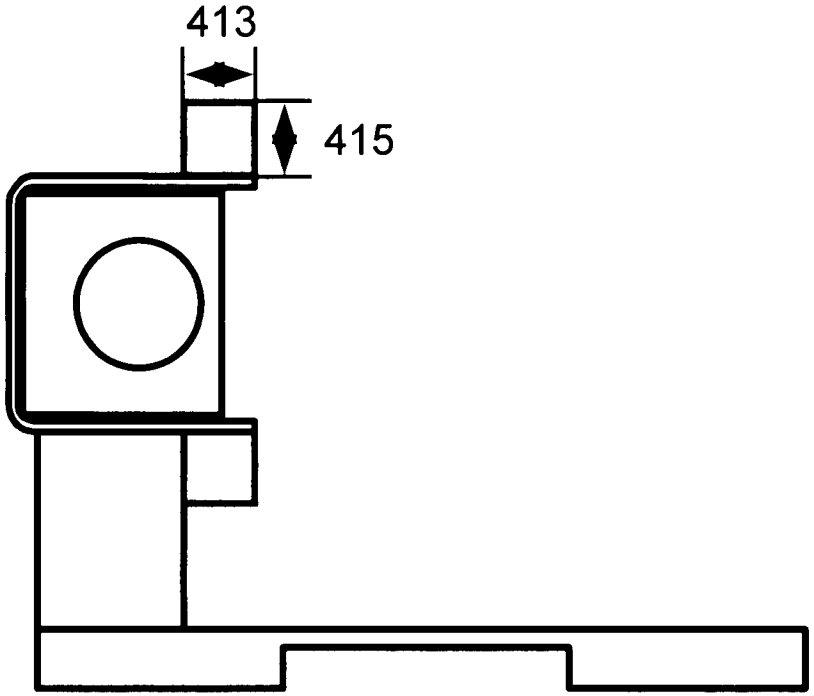
FIG. 4D shows a subassembly comprising Applicants' slide rails attached to Applicants' barrel housing.

Referring now to FIGS. 4A, 4B, and 4C, first slide rail 410 and second slide rail 420 are attached to housing 310 such that side 416 and side 426 are flush with edge 342 and edge 322, respectively, of housing 310. In other embodiments, slide rail 420 is attached to the side of riser 210 such that side 426 is flush with edge 322.

In certain embodiments, slide rail 410 and slide rail 420 are formed from a rigid material, such as without limitation wood, metal, molded plastic, leather, combinations thereof, and the like. Slide rail 410 and slide rail 420 comprise length 430, width 413, and thickness 415. In certain embodiments, length 430 is between about 2 inches and about 10 inches. In certain embodiments, length 430 is about 6 inches. In certain embodiments, width 413 is between about 0.25 inches and about 1 inch. In certain embodiments, width 413 is about 0.375 inches. In certain embodiments, thickness 415 is between about 0.25 inches and about 1 inch. In certain embodiments, thickness 415 is about 0.375 inches.

In certain embodiments, slide rail 410 and slide rail 420 are attached to housing 310 using conventional attachment means, such as and without limitation adhesive bonding, welding, plastic welding, mechanical fasteners, i.e. nuts, bolts, and the like. In certain embodiments, slide rail 410, slide rail 420, and housing 310 comprise an integrally molded assembly.

Slide rail 410 comprises a tubular member formed to include aperture 440. In certain embodiments, aperture 440 is about 4 inches long and about 0.25 inches wide. Slide rail 420 comprises a tubular member formed to include aperture 450. In certain embodiments, aperture 450 is about 4 inches long and about 0.25 inches wide.

Referring now to FIGS. 5A, 5B, 5C, and 5D, slide block 510 is slidingly disposed in aperture 440. Slide block 510 comprises first end 512 and opposing second end 514. Slide block 520 is slidingly disposed in aperture 450. Slide block 520 comprises first end 522 and opposing second end 524.

Figure 5A:
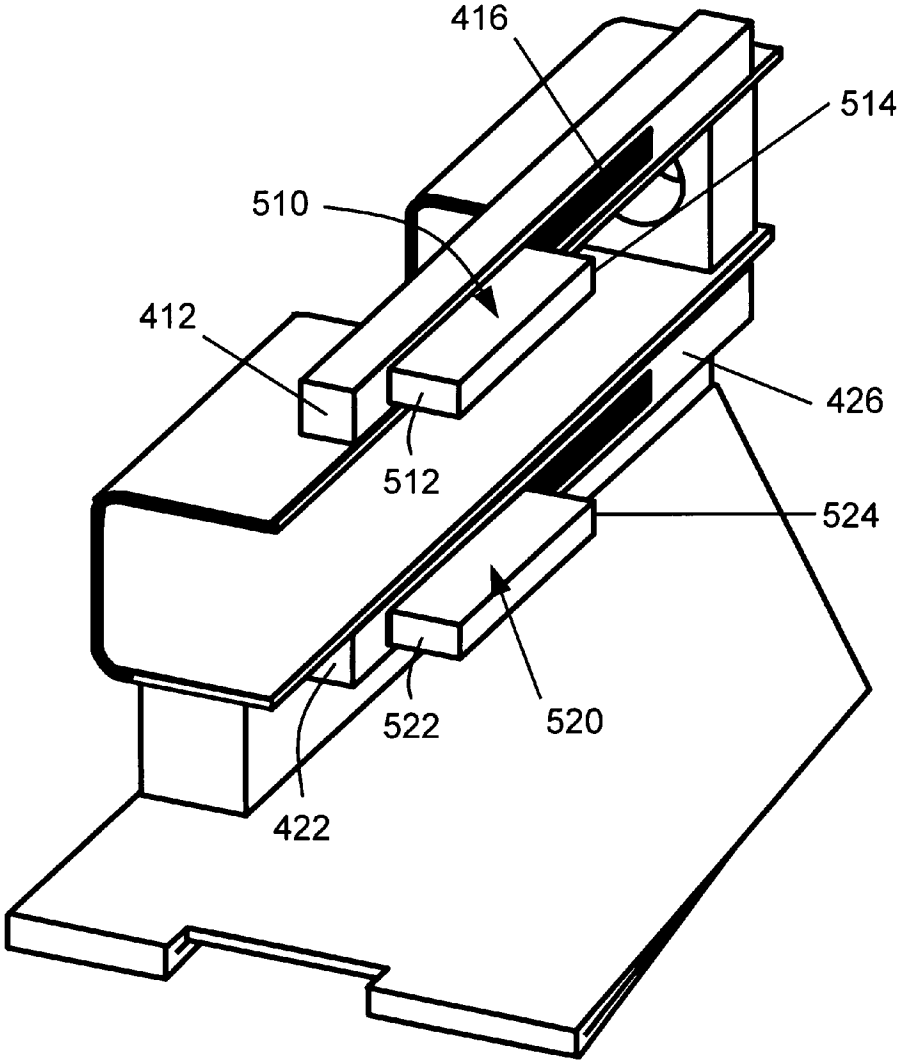
FIG. 5A is a perspective view showing the elements of FIG. 4A in combination with a slide block moveably disposed within each of Applicants' slide rails, wherein those slide blocks are disposed in a first position.
Figure 5B:
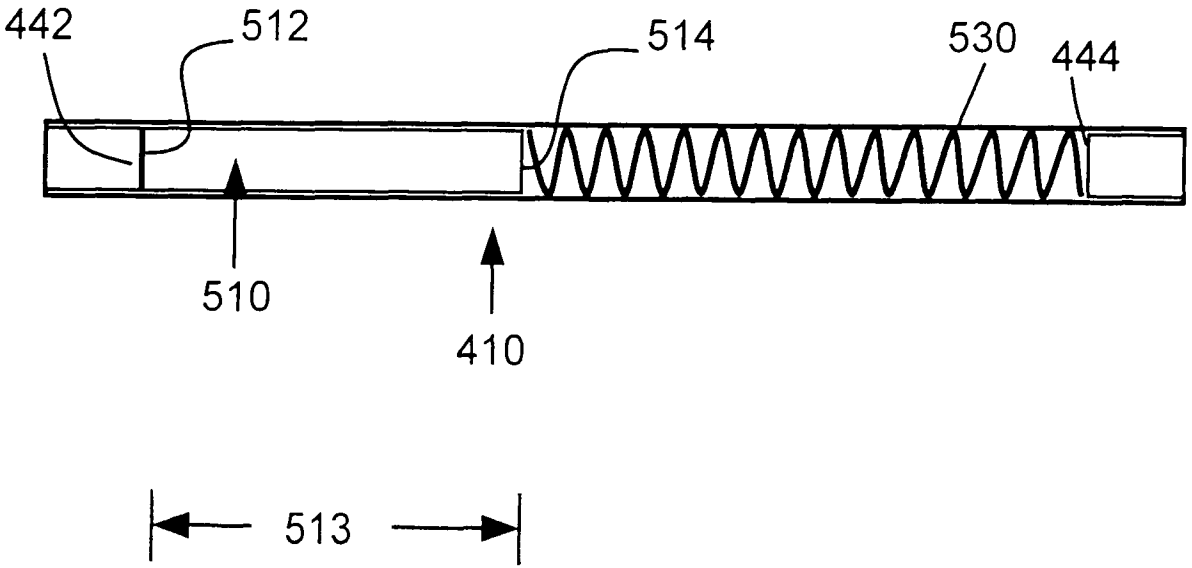
FIG. 5B is a side view of a first slide rail formed to include a first aperture, wherein a first spring and a first slide block are disposed within that first aperture, wherein the first slide block is in a first position and wherein the first spring comprises an elongated configuration.
Figure 5C:
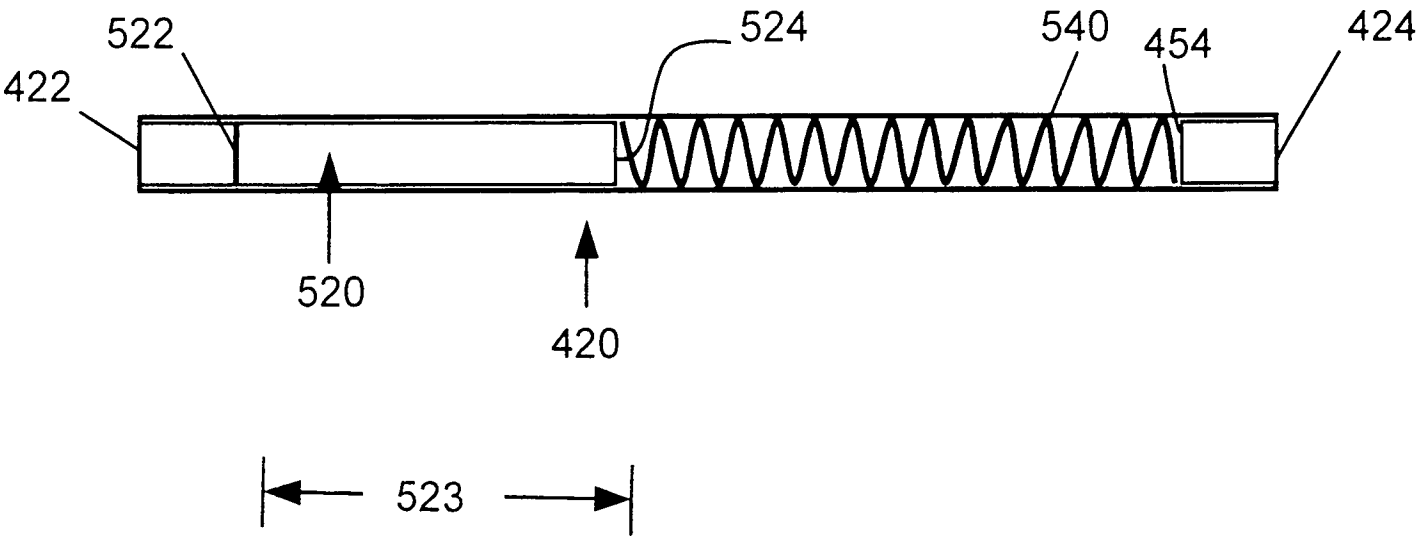
FIG. 5C is a side view of a second slide rail formed to include a second aperture, wherein a second spring and a second slide block are disposed within that second aperture, wherein the second slide block is in a first position and wherein the second spring comprises an elongated configuration.
Figure 5D:
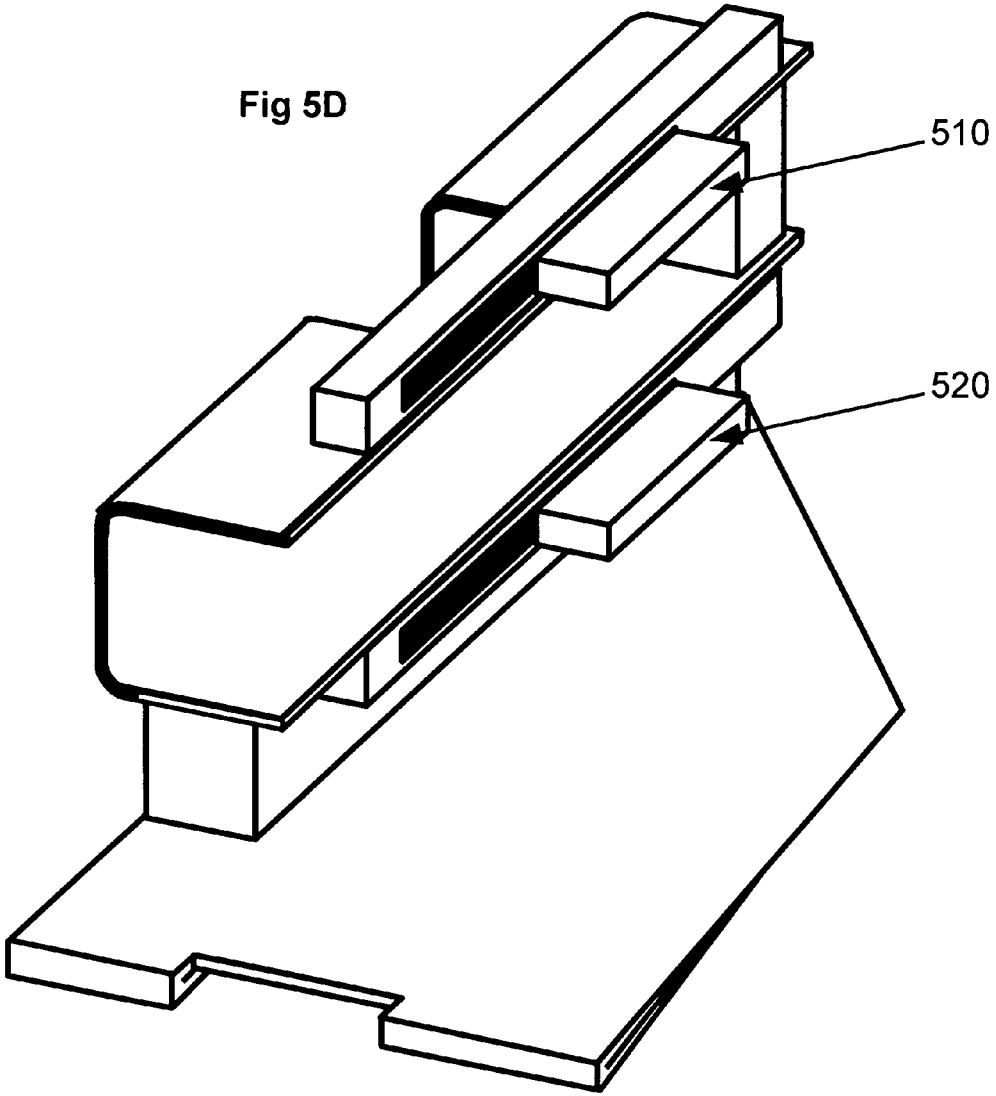
FIG. 5D is a perspective view showing Applicants' slide blocks moved to a second position.
Figure 5E:
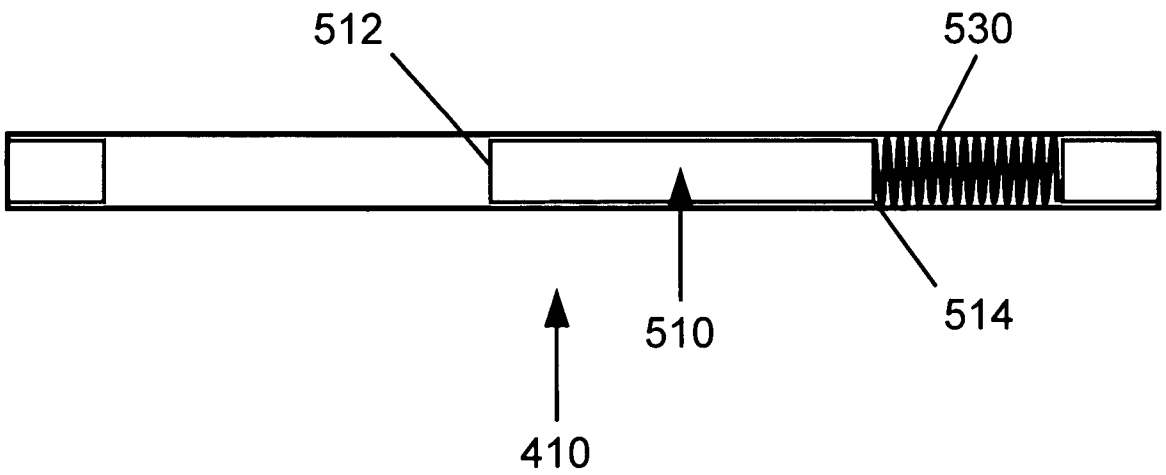
FIG. 5E is a side view of the first slide rail of FIG. 5B, wherein the first slide block is in the second position of FIG. 5D, and wherein the first spring comprises a compressed configuration.
Figure 5F:
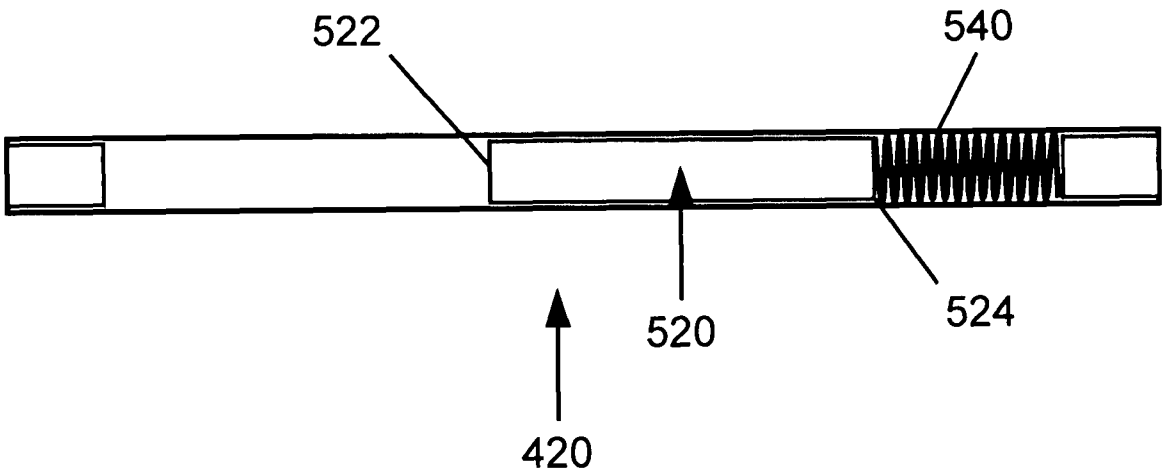
FIG. 5F is a side view of the second slide rail of FIG. 5C, wherein the second slide block is in the second position of FIG. 5D, and wherein the second spring comprises a compressed configuration.
Figure 5G:
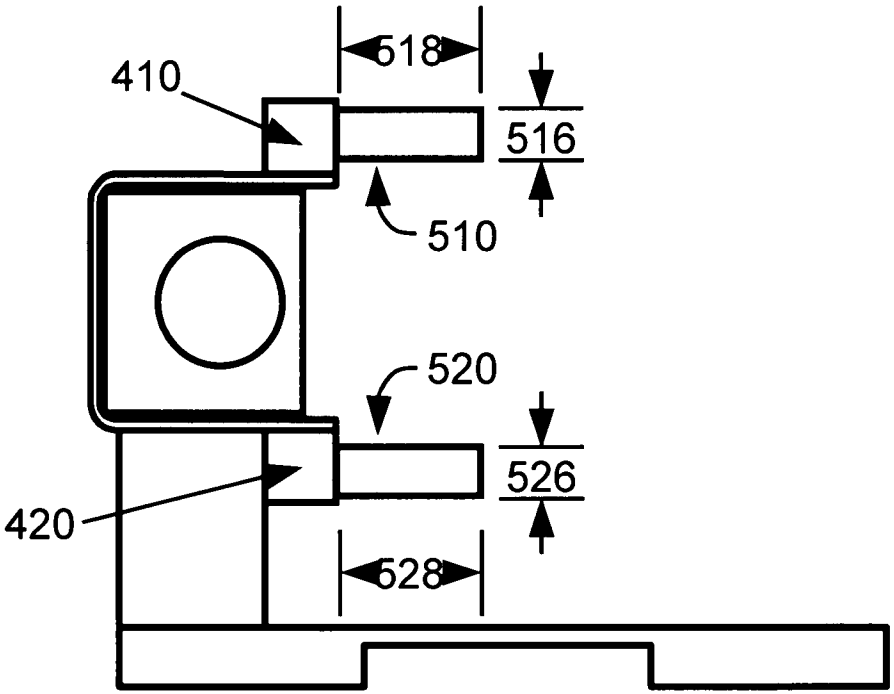
FIG. 5G is a side view showing the elements of FIG. 5A.

Referring now to FIGS. 5B and 5G, slide block 510 comprises length 513 and width 516. Slide block 510 extends outwardly from slide rail 410 a distance 518. Referring now to FIGS. 5C and 5G, slide block 520 comprises length 523, and width 526. Slide block 520 extends outwardly from slide rail 420 a distance 528.

In certain embodiments, lengths 513 and 523 are between about 0.50 inches and about 3 inches. In certain embodiments, lengths 513 and 523 are about 2 inches. In certain embodiments, distance 518 is between about 0.25 inches and about 1.50 inches. In certain embodiments, distance 518 is about 0.75 inches. In certain embodiments, distance 528 is between about 0.25 inches and about 1.50 inches. In certain embodiments, distance 528 is about 0.75 inches.

In certain embodiments, width 516 is between about 0.12 inches and about 0.50 inch. In certain embodiments, width 516 is about 0.25 inches. In certain embodiments, width 526 is between about 0.12 inches and about 0.50 inch. In certain embodiments, width 526 is about 0.25 inches.

Referring now to FIG. 5B, spring 530 is disposed within aperture 440 with one end of that springe in contact with end 514 of slide block 510. In the illustrated embodiment of FIG. 5B, spring 530 exerts a first force against slide block 510 thereby disposing slide block in 510 the first configuration shown in FIGS. 5A and 5B. Referring now to FIG. 5C, spring 540 is disposed within aperture 450 with one end of that spring in contact with end 524 of slide block 520. In the illustrated embodiment of FIG. 5C, spring 540 exerts a second force against slide block 520 thereby disposing slide block 520 in the first configuration shown in FIGS. 5A and 5C.

FIG. 5D shows slide block 510 and slide block 520 in a second configuration. Referring now to FIGS. 5D and 5E, when slide block 510 is moved fowardly within aperture 440 into the second configuration of FIG. 5D, spring 530 is placed in the compressed configuration shown in FIG. 5E. When slide block 510 is slidingly moved from the first position of FIGS. 5A and 5B to the second position of FIGS. 5D and 5E, spring 530 exerts a third force on slide block 510, wherein that third force is greater than the first force described hereinabove.

Referring now to FIGS. 5D and 5F, when slide block 520 is moved fowardly within aperture 450 into the second configuration of FIG. 5D, spring 540 is placed in the compressed configuration shown in FIG. 5F. When slide block 520 is slidingly moved from the first position of FIGS. 5A and 5C to the second position of FIGS. 5D and 5F, spring 540 exerts a fourth force on slide block 520, wherein that fourth force is greater than the second force described hereinabove.

Figure 6A:
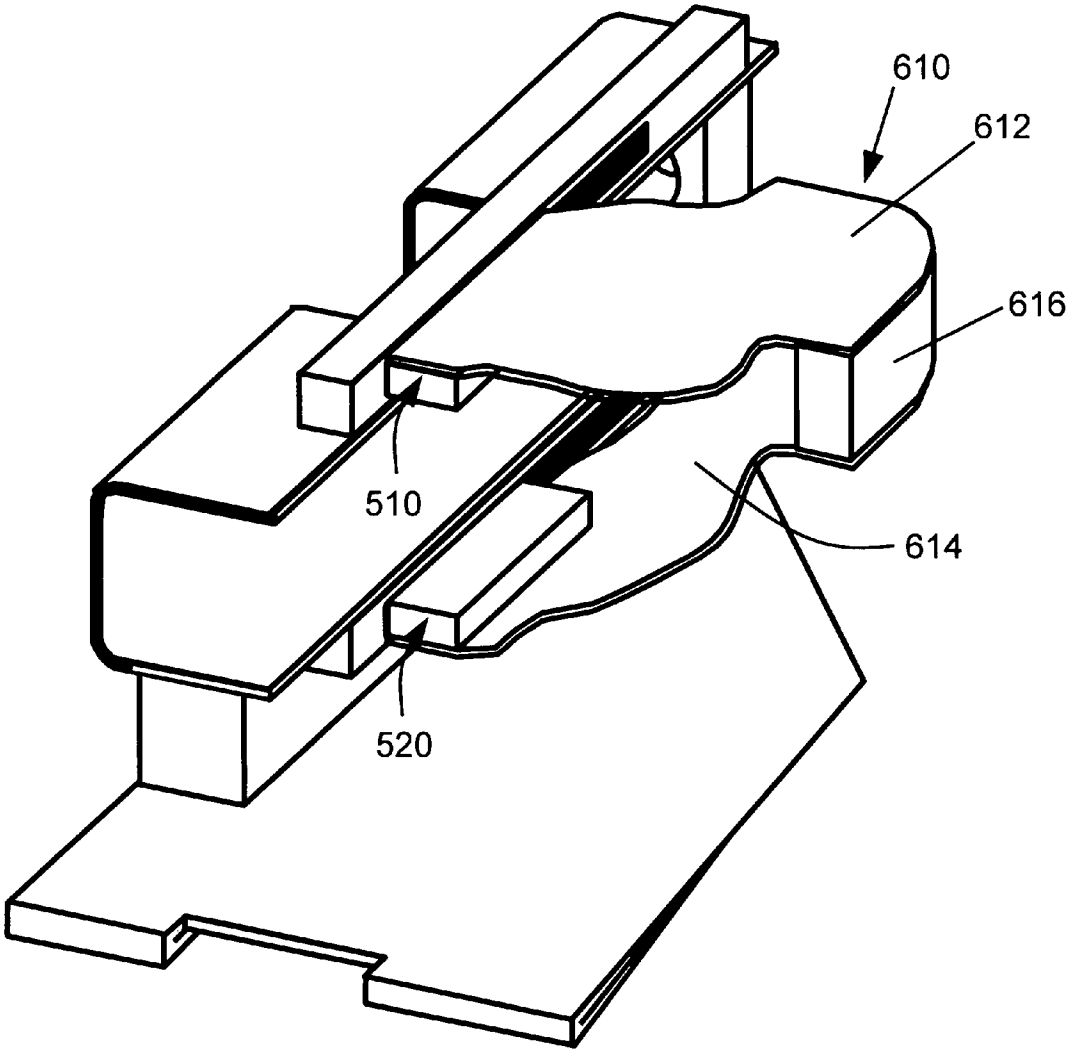
FIG. 6A is a perspective view showing the elements of FIG. 5A in combination with Applicants' trigger guard.
Figure 6B:
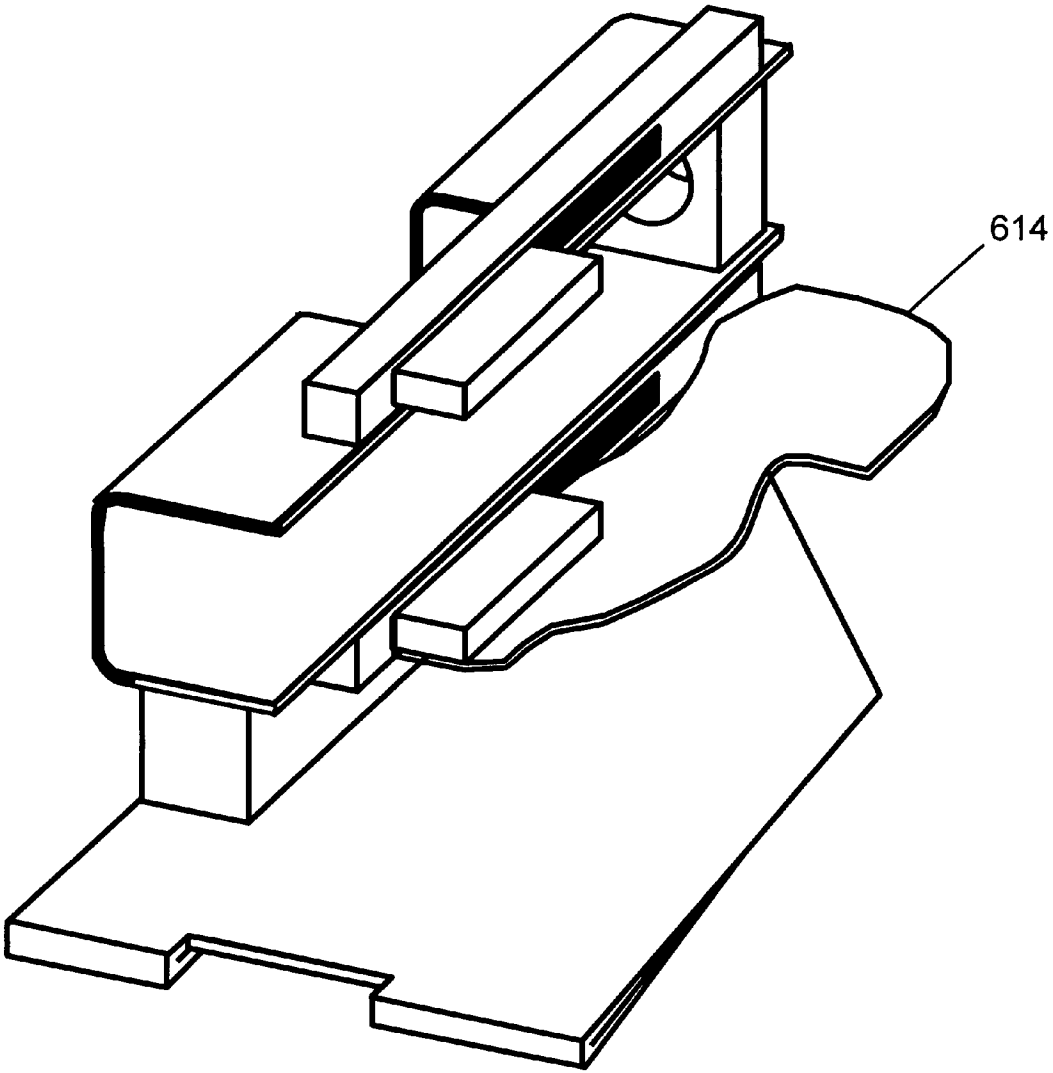
FIG. 6B is a perspective view showing an element of Applicants' trigger guard.
Figure 6C:
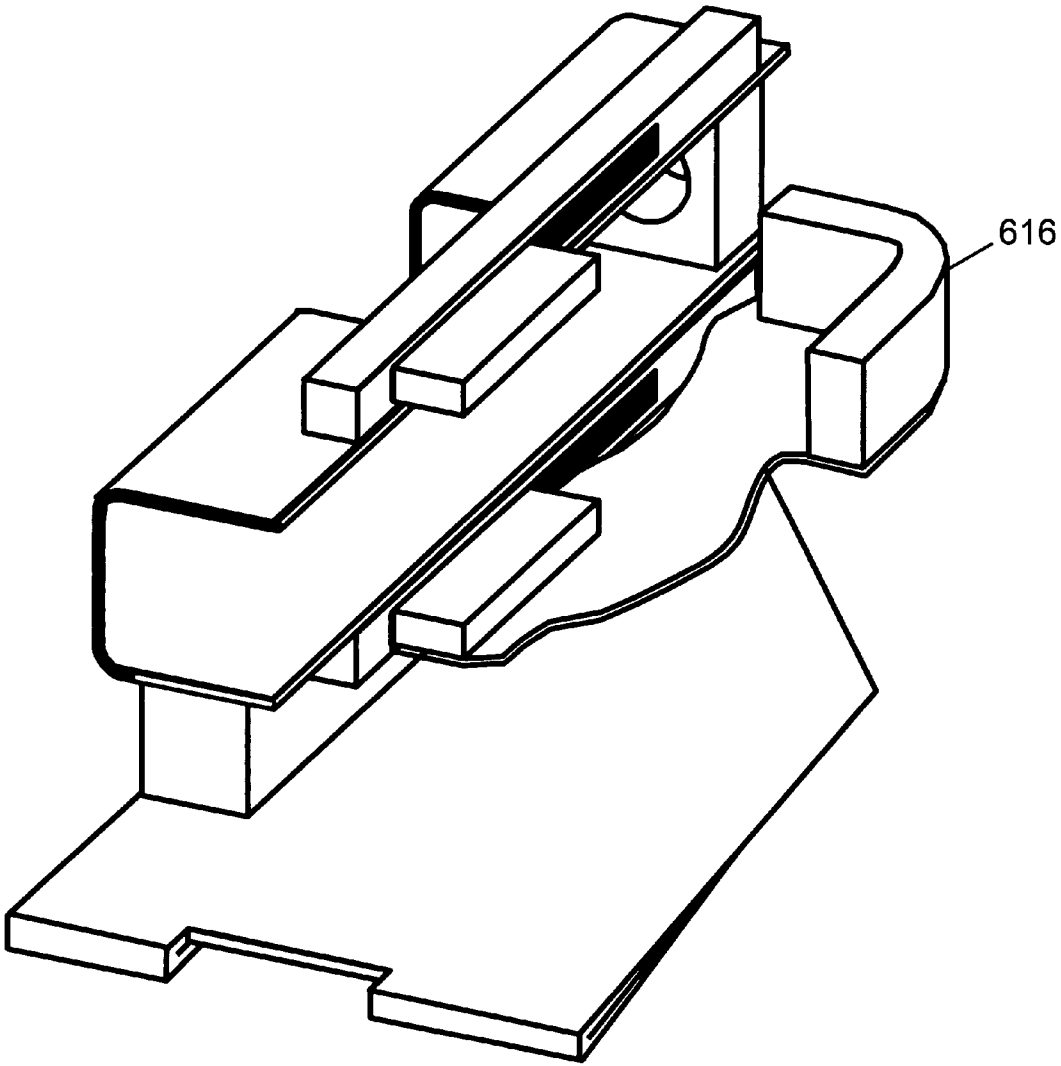
FIG. 6C is a perspective view showing an additional element of Applicants' trigger guard.

Referring now to FIGS. 6A, 6B, and 6C, trigger guard 610 comprises side member 612, side member 614, and interconnecting member 616. In the illustrated embodiment of FIGS. 6A, 6B, and 6C, side member 612, side member 614, and interconnecting member 616 comprise irregular-shaped members. In certain embodiments, trigger guard 610 comprises an integrally molded assembly. In other embodiments, side member 612, side member 614, and interconnecting member 616, are separately formed and then attached as shown using conventional attachment means. Side members 612 and 614 are attached to slide block 510 and slide block 520, respectively, and extend outwardly therefrom.

Figure 7B:
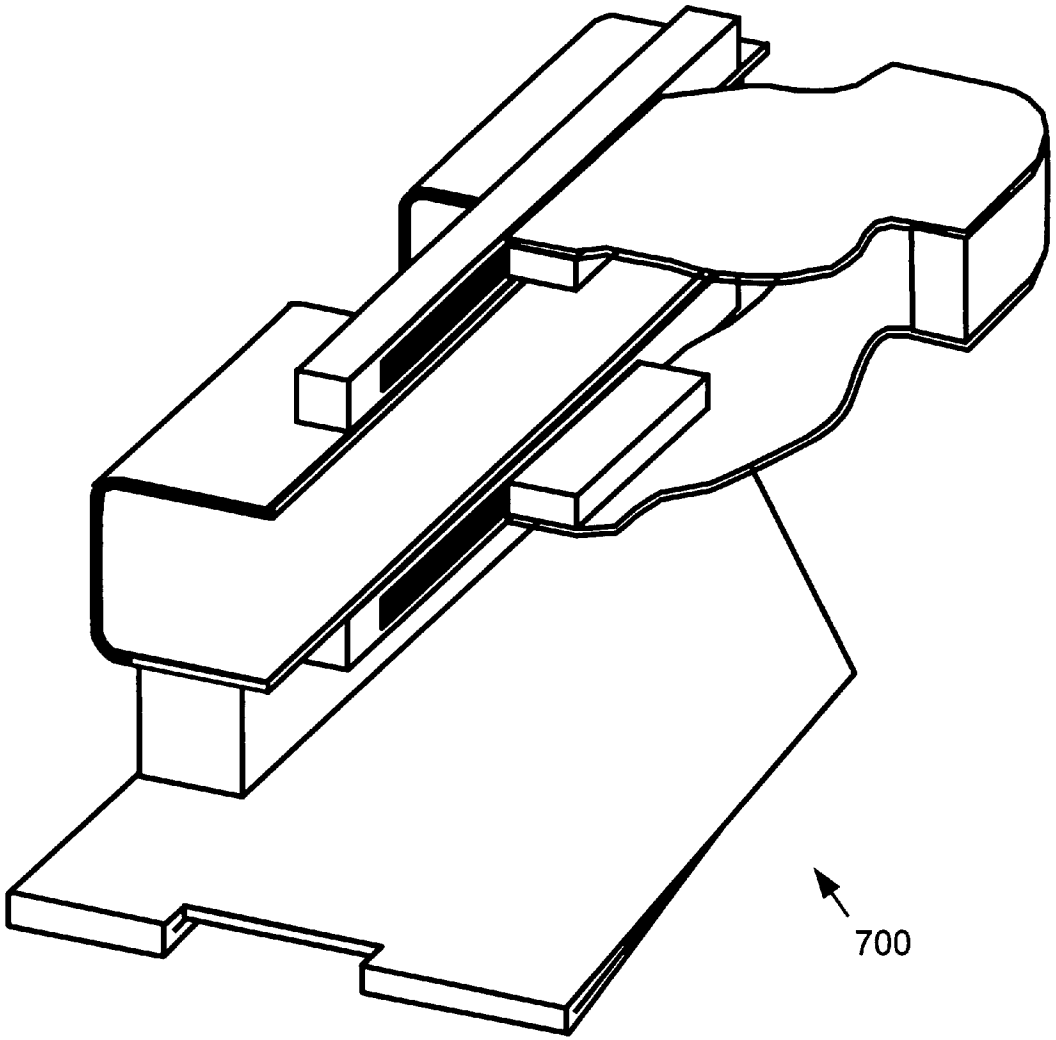
FIG. 7B is a perspective view of Applicant's holster showing the moveable trigger guard in a second position.

FIGS. 7A and 8A show holser assembly 700 wherein moveable trigger guard 610 is disposed in a first position. FIG. 7B shows and 8B show holster assembly 700 wherein moveable trigger guard 610 has been slidably moved to a second position to load pistol 810.

Figure 9:
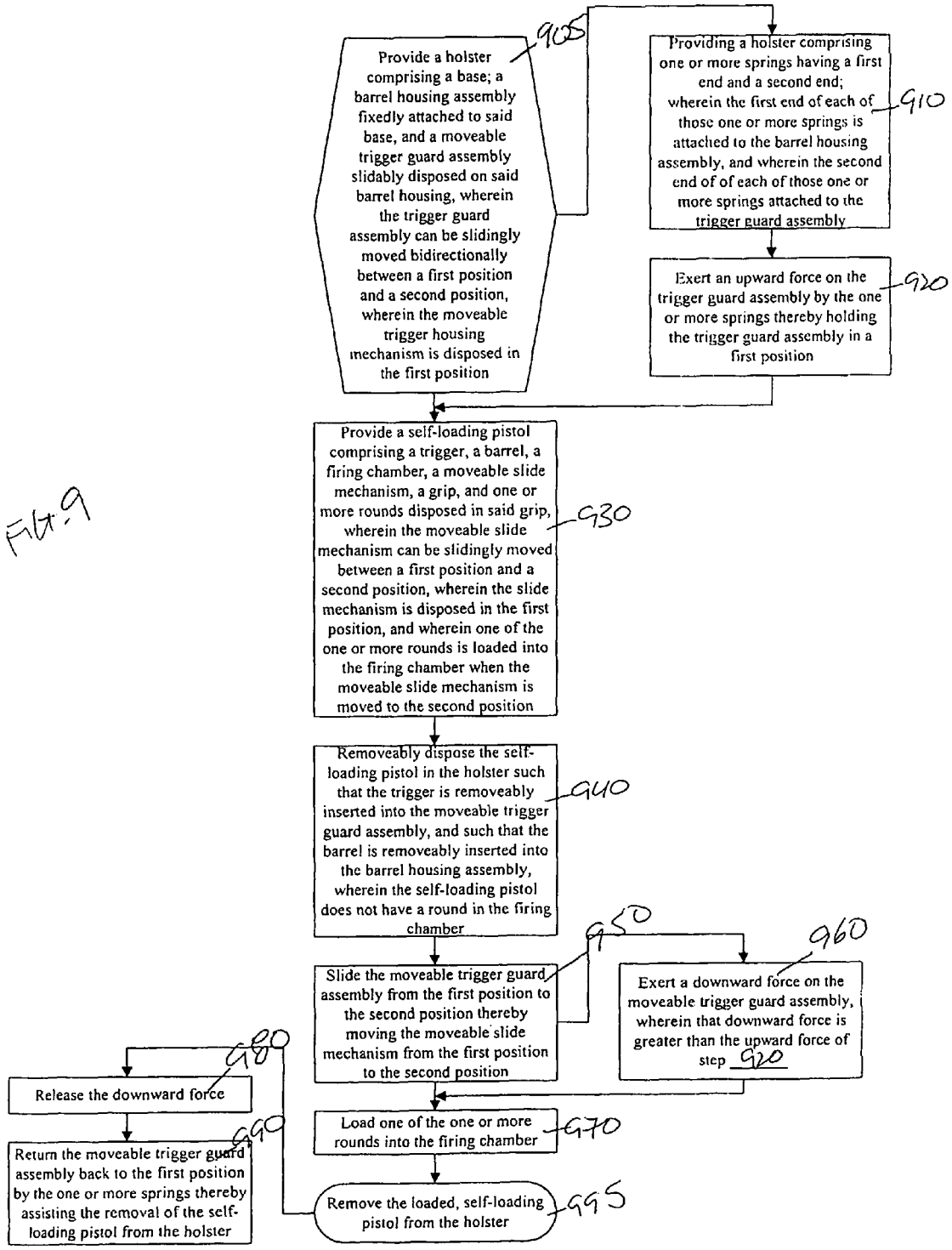
FIG. 9 is a flow chart summarizing the steps of Applicant's method.

Applicant's invention comprises a method to holster and load a self-loading pistol, wherein that pistol as initially holstered using Applicant's holster assembly and method does not have a round in the firing chamber. FIG. 9 summarizes the steps of Applicant's method.

Referring now to FIGS. 8 and 9, in step 905 Applicant's method provides a holster, such as Applicant's holster assembly 700 as described herein, comprising a base; a barrel housing assembly fixedly attached to the base, and a moveable trigger guard assembly slidably disposed on the barrel housing assembly. In certain embodiments, Applicant's barrel housing assembly comprises housing 310 in combination with slide rail 410, and slide rail 420. In certain embodiments, Applicants' moveable trigger guard assembly comprises trigger guard 610 in combination with slide block 510 and slide block 520. Applicants' trigger guard assembly can be slidingly moved bidirectionally between a first position shown in FIG. 7A and a second position shown in FIG. 7B, wherein the moveable trigger guard assembly is initially disposed in the first position shown in FIG. 7A.

In certain embodiments, step 905 further comprises steps 910 and 920. Referring now to FIGS. 5B, 5C, 7A, and 9, in step 910 Applicant's method provides a holster comprising one or more springs, such as spring 530 and/or spring 540, wherein each of those one or more springs is disposed between a portion of Applicants' barrel housing assembly and a portion of Applicant's moveable trigger guard assembly. In step 920, the one or more springs of step 910 exert an aggregate upward force, holding Applicants' moveable trigger guard assembly in a first position shown in FIG. 7A.

In step 930, Applicant's method provides a self-loading pistol comprising a trigger, a barrel, a firing chamber, a moveable slide mechanism, a grip, and one or more rounds disposed in the grip, wherein the moveable slide mechanism can be slidingly moved between a first position and a second position, wherein the slide mechanism is disposed in the first position. One of the one or more rounds is loaded into the firing chamber when the moveable slide mechanism is moved to the second position As those skilled in the art will appreciate, a self-loading pistol reloads the firing chamber with a new round automatically each time the weapon is fired, without additional action by the user. This is accomplished by recoil. As those skilled in the art will further appreciate, a semi-automatic pistol will fire only one shot per trigger pull, in contrast to a "fully automatic" pistol which continues to fire as long as the trigger is held back or until all rounds have been fired.

Figure 8B:
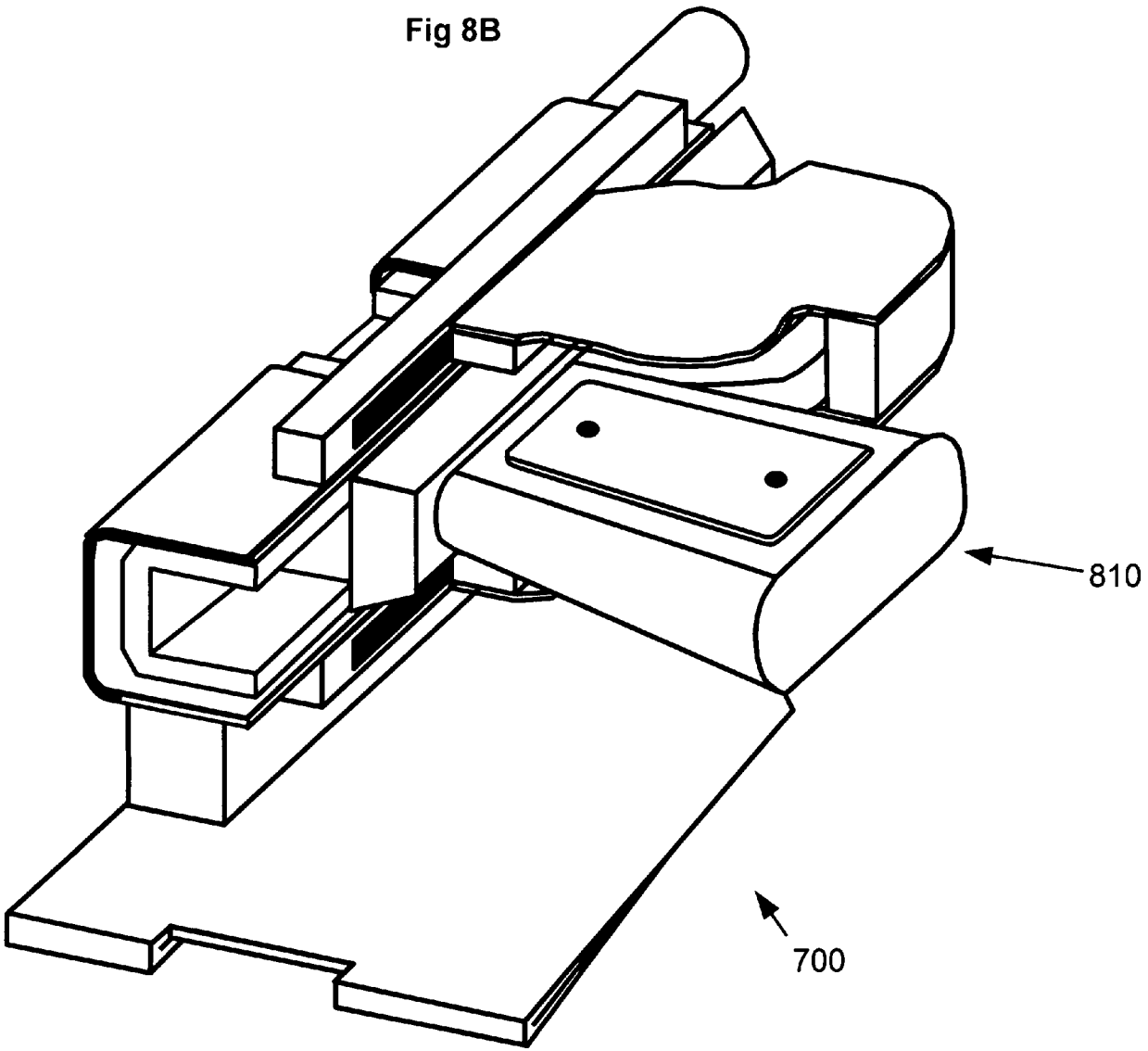
FIG. 8B is a perspective view showing a pistol removeably disposed within Applicants' holster assembly, wherein Applicants' moveable trigger guard is shown in the second position of FIG. 7B.
Figure 8C:
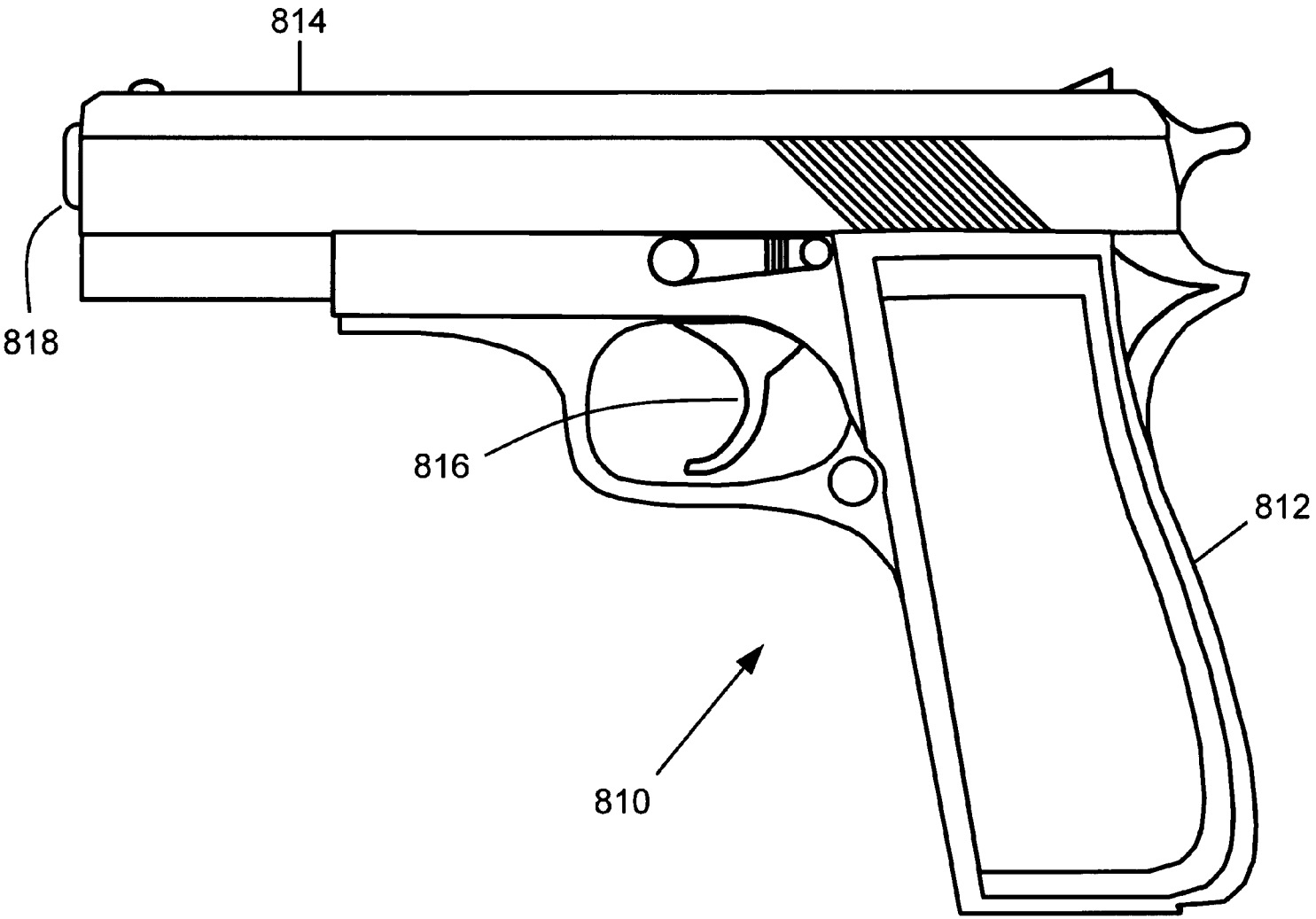
FIG. 8C is a side view of a self-loading pistol in an operational configuration.

Referring now to FIG. 8C, self-loading pistol 810 comprises grip 812, slide mechanism 814, trigger 816, and barrel 818. In certain embodiments, pistol 810 further comprises a clip mechanism disposed within grip 812, wherein that clip mechanism is designed to hold a plurality of rounds, i.e. bullets, and to feed a round into the firing chamber each time a round is fired.

Figure 8D:
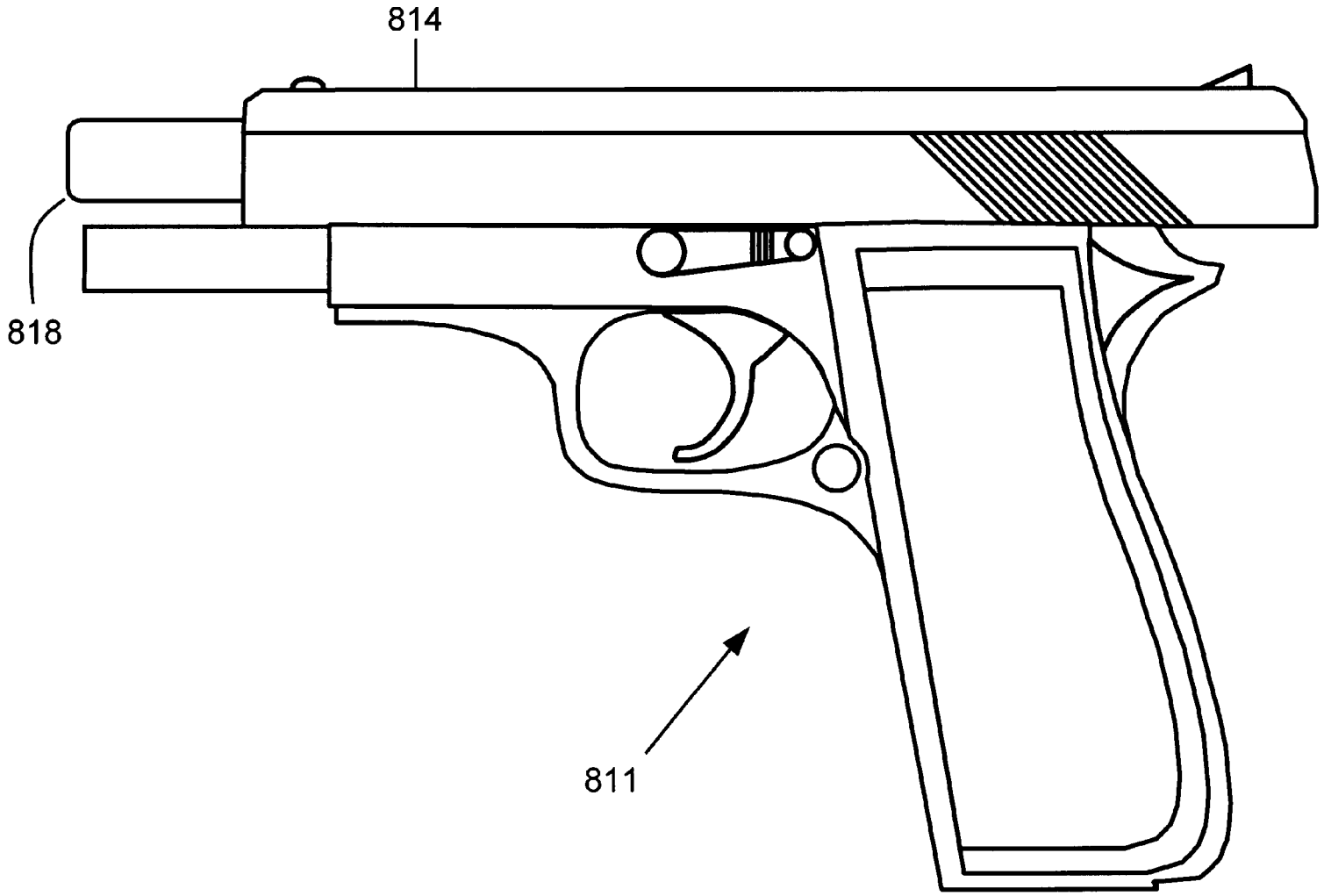
FIG. 8D is a side view of the pistol of FIG. 8C in a loading configuration.

Referring now to FIG. 8D, in order to load a round into the firing chamber slide mechanism 814 is moved backwardly manually to configuration 811, thereby causing the clip mechanism to load a round into the firing chamber. In certain embodiments, moving slide mechanism 814 backwardly also cocks a trigger. After loading a round, and optionally cocking a trigger, an internal spring mechanism pulls slide mechanism forward to the configuration shown in FIG. 8C with a round loaded in the firing chamber. As described above, after firing a first round, pistol 810 automatically reloads until the supply of rounds disposed in the clip assembly is depleted.

Referring once again to FIG. 9, in step 940 Applicant's method removeably disposes the self-loading pistol of step 930 in the holster of step 905 such that the trigger is removeably inserted into the moveable trigger guard assembly, and such that the barrel is removeably inserted into the barrel housing assembly, wherein the self-loading pistol does not have a round in the firing chamber. Referring now to FIGS. 8A and 8C, FIG. 8A shows pistol 810 removeably disposed in Applicant's holster assembly 700 such that barrel portion 818 is removeably disposed in the barrel housing assembly of Applicant's holster, and such that trigger 816 is removeably disposed in Applicant's trigger guard assembly, as that assembly is described and defined herein.

In step 950, Applicant's method slides the moveable trigger guard assembly from the first position of FIG. 8A to the second position of FIG. 8B, thereby sliding the moveable slide mechanism 814 from the first position of FIG. 8C to the second position of FIG. 8D. Step 950 comprises exerting a downward force on grip 812, thereby sliding moveable trigger guard assembly from the first position shown in FIG. 8A to the second position shown in FIG. 8B, thereby placing pistol 810 in the loading configuration shown in FIG. 8D. Referring now to FIGS. 5E, 5F, and 8B, sliding Applicant's trigger guard assembly to the second position shown in FIG. 8B, compresses spring 530 and/or spring 540 as shown in FIGS. 5E and 5F, respectively.

After pistol 810 is placed in the loading configuration of FIG. 8D, in step 970, a round is disposed in the firing chamber thereby "loading" the pistol. In step 995, Applicant's method removes the loaded pistol from Applicant's holster assembly. In certain embodiments, step 995 comprises steps 980 and 990. In step 980, Applicant's method releases the downward force exerted in step 960. In step 990, the one or more compressed springs 530 and/or 540 push the trigger guard assembly back to the first position thereby assisting the removal of pistol 810 from holster assembly 700.

In addition to the one-handed operation described above wherein a user can load, cock, and fire pistol 810 using only one hand, Applicant's holster assembly 700 also allows the user to unload pistol 810 using one hand. After the user has cycled, drawn, and fired pistol 810, there may be a live round in the firing chamber. The user then, using the hand carrying pistol 810 causes pistol 810 to eject the clip, and any live rounds disposed therein, from grip portion 812, and then using that same hand inserts pistol 810 into holster assembly 700, and using that same hand pushes pistol 810 downwardly such that pistol 810 is disposed in the configuration of FIG. 8D. Disposing pistol 810 in the configuration of FIG. 8D causes the live round in the firing chamber to be ejected through aperture 350 in barrel housing 310, thereby unloading pistol 810. Another live round cannot be placed in the firing chamber because the clip has been removed.

Moreover, in an emergency the user may forget that pistol 810 has a round in the firing chamber when the user cycles the pistol using Applicant's holster assembly 700. In such an event, the round already disposed in the firing chamber is ejected, and a different live round is placed into the chamber from the loaded magazine or clip.

In addition to using Applicant's holster assembly to implement Applicant's method recited hereinabove, holster assembly 700 can also be used to carry pistol 810 without using Applicant's method. In such an embodiment, pistol 810 is withdrawn from holster assembly 700 without pushing that pistol downwardly to load a round in the firing chamber, and without engaging the upward pull of compressed springs 530 and/or 540 to assist removal of the pistol from the holster assembly.

Whether being used as a prior art holster device, or being used to implement Applicant's method, Applicant's holster assembly 700 can be fashioned to work with either a right-handed carry, or a left-handed carry. By "right-handed carry," Applicant's mean that pistol 810 is grasped using the right hand, pushed downwardly using the right hand, and removed from holster assembly 700 using the right hand.

While the preferred embodiments of the present invention have been illustrated in detail, it should be apparent that modifications and adaptations to those embodiments may occur to one skilled in the art without departing from the scope of the present invention as set forth in the following claims.

We claim:

1. A method to carry and load a self-loading pistol, comprising the steps of:

providing a holster comprising a base; a barrel housing assembly fixedly attached to said base; and a moveable trigger guard assembly slidably attached to said barrel housing assembly, wherein said moveable trigger guard assembly can be slidingly moved bidirectionally between a first position and a second position, and wherein said moveable trigger guard assembly is disposed in said first position;

providing a self-loading pistol comprising a trigger, a barrel, a firing chamber, a moveable slide mechanism, a grip, and one or more rounds disposed in said grip, wherein said moveable slide mechanism can be slidingly moved between a first position and a second position, wherein said slide mechanism is disposed in said first position, and wherein one of said one or more rounds is loaded into said firing chamber when said moveable slide mechanism is moved to said second position;

removeably disposing said self-loading pistol in said holster such that said trigger is removeably inserted into said moveable trigger guard assembly, and such that said barrel is removeably inserted into said barrel housing assembly, wherein said self-loading pistol does not have a round in the firing chamber, wherein said self-loading pistol without a round in the firing chamber can be removed from said holster without moving said moveable trigger housing mechanism;

sliding said moveable trigger guard assembly from said first position to said second position thereby moving said moveable slide mechanism from said first position to said second position;

loading one of said one or more rounds into said firing chamber;

removing said self-loading pistol from said holster.

2. The method of claim 1, wherein said providing a holster step further comprises the steps of:

providing a barrel housing assembly comprising a barrel housing attached to said base and a first slide rail disposed on said barrel housing, wherein said first slide rail is formed to include a first aperture;

providing a first spring;

disposing said first spring within said first aperture;

providing a moveable trigger guard assembly comprising a first slide block;

moveably disposing said first slide block within said first aperture.

3. The method of claim 2, wherein said providing a holster step further comprises the steps of:

providing a barrel housing assembly comprising a second slide rail disposed on said barrel housing, wherein said second slide rail is formed to include a second aperture;

providing a second spring;

disposing said second spring within said second aperture;

providing a moveable trigger guard assembly comprising a second slide block;

moveably disposing said second slide block within said second aperture.

4. The method of claim 2, wherein said providing a holster step further comprises the steps of providing a holster comprising one or more springs disposed between said barrel housing assembly and said moveable trigger guard assembly.

5. The method of claim 4, further comprising the steps of:

exerting a first force on said trigger guard assembly by said one or more springs thereby holding said trigger guard assembly in said first position;

wherein said sliding said moveable trigger guard assembly from said first position to said second position step further comprises exerting a second force on said moveable trigger guard assembly in a direction opposite to said first force, wherein said second force is greater than said first force.

6. The method of claim 5, wherein removing said self-loading pistol from said holster step further comprises the steps of:

releasing said second force;

pushing by said one or more springs said moveable trigger guard assembly back to said first position thereby assisting the removal of said self-loading pistol from said holster.

* * * * *